US006755626B2

(12) United States Patent
Komatsu et al.

(10) Patent No.: US 6,755,626 B2
(45) Date of Patent: Jun. 29, 2004

(54) MINIATURE PUMP, COOLING SYSTEM AND PORTABLE EQUIPMENT

(75) Inventors: Atsushi Komatsu, Osaka (JP); Masayuki Okano, Kawanishi (JP); Katsumi Imada, Nara (JP); Toru Ninomiya, Yawata (JP); Yusuke Adachi, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 33 days.

(21) Appl. No.: 10/194,519

(22) Filed: Jul. 11, 2002

(65) Prior Publication Data

US 2003/0017063 A1 Jan. 23, 2003

(30) Foreign Application Priority Data

Jul. 18, 2001 (JP) ..... 2001-217644

(51) Int. Cl.[7] ..... F04B 17/00
(52) U.S. Cl. ..... 417/413.2; 417/313; 62/118
(58) Field of Search ..... 417/313, 413.2, 417/566, 571; 62/118

(56) References Cited

U.S. PATENT DOCUMENTS 3,833,013 A 9/1975 Leonard
3,951,147 A 4/1976 Tucker et al.
4,604,090 A 8/1986 Reinicke
4,728,969 A 3/1988 Le et al.
5,349,499 A * 9/1994 Yamada et al. ..... 361/700
5,764,483 A 6/1998 Ohashi et al. ..... 361/699
6,485,275 B1 * 11/2002 Takeuchi et al. ..... 417/413.2

FOREIGN PATENT DOCUMENTS

EP 0 465 229 1/1992
JP 7-142886 6/1995

* cited by examiner

*Primary Examiner*—Justine R. Yu
*Assistant Examiner*—William H. Rodriguez
(74) *Attorney, Agent, or Firm*—Merchant & Gould, P.C.

(57) ABSTRACT

A miniature pump includes a miniature pump portion including a suction passage through which a liquid flows in, and a discharge passage through which the liquid flows out, and a bubble trap portion for blocking an entry of air bubbles into the miniature pump portion. Since the bubble trap portion prevents the entry of air bubbles into the miniature pump portion, a deterioration of pump characteristics owing to the entry of air bubbles can be suppressed, making it possible to obtain a miniature pump that achieves both a large discharge flow rate and stable discharge flow rate characteristics.

11 Claims, 16 Drawing Sheets

MINIATURE PUMP, COOLING SYSTEM AND PORTABLE EQUIPMENT

BACKGROUND OF THE INVENTION

1. Field of the Invention

The present invention relates to a miniature pump that can be used in a cooling system or the like. It relates in particular to a miniature pump with improved stable-discharge characteristics. Furthermore, the present invention relates to a cooling system and portable equipment using such a miniature pump.

2. Description of Related Art

In conventional diaphragm type miniature pumps, their sizes have been reduced considerably by adopting a vibrating plate made of a piezoelectric element, for example, PZT. FIG. 18 shows an example thereof.

In this figure, numeral 300 denotes a piezoelectric vibrating plate including a piezoelectric substrate 310 and a vibrating plate 320, numeral 330 denotes suction and exhaust valves for controlling a liquid flow, and numeral 340 denotes a casing forming a pressure chamber 500 and a flow passage. The piezoelectric substrate 310 is attached to the vibrating plate 320 so as to form the piezoelectric vibrating plate 300 serving as a diaphragm. An AC voltage is applied to the piezoelectric substrate 310 of this piezoelectric vibrating plate 300, thereby concaving or convexing the piezoelectric vibrating plate 300. The resulting change in volume of the pressure chamber 500 and the resulting movement of the valves 330 bring about a pumping function.

Next, the movement of the valves and that of the piezoelectric vibrating plate during suction and exhaustion will be described more specifically referring to FIGS. 19A and 19B. In these figures, arrows 10 indicate a liquid flow direction.

FIG. 19A shows a sucking operation of the miniature pump, and FIG. 19B shows a discharging operation thereof. As shown in these figures, an AC voltage is applied to the piezoelectric vibrating plate 300 so as to deform it toward the direction that increases the volume of the pressure chamber 500, thereby sucking a fluid through a suction valve 330*a* into the pressure chamber 500 (see FIG. 19A). Also, the application of an AC voltage causes the piezoelectric vibrating plate 300 to deform in the direction that decreases the volume of the pressure chamber 500, thereby discharging the fluid, which has been sucked into the pressure chamber 500, from a discharge port through an exhaust valve 330*b* (see FIG. 19B).

However, although the above-described conventional diaphragm type miniature pumps can be made much smaller than those converting a rotational motion of a motor into a reciprocating motion using a motion converter so as to drive a diaphragm, it is difficult to increase the area of the diaphragm. Accordingly, when it comes to a pumping performance, the discharge flow rate has been rather small. For example, in the case where a unimorph type piezoelectric vibrating plate with a diameter of 25 mm was used as a driving source and driven at an AC voltage of 100 V rms, only a flow rate of about 30 $cm^3$/min was obtained with respect to 60 Hz driving.

SUMMARY OF THE INVENTION

It is an object of the present invention to provide a miniature pump that achieves both a large discharge flow rate and stable discharge flow rate characteristics, and a cooling system and portable equipment using this miniature pump.

In order to achieve the above-mentioned object, a miniature pump of the present invention includes a miniature pump portion including a suction passage through which a liquid flows in, and a discharge passage through which the liquid flows out; and a bubble trap portion for blocking an entry of air bubbles into the miniature pump portion.

DESCRIPTION OF THE PREFERRED EMBODIMENTS

Figure 1:
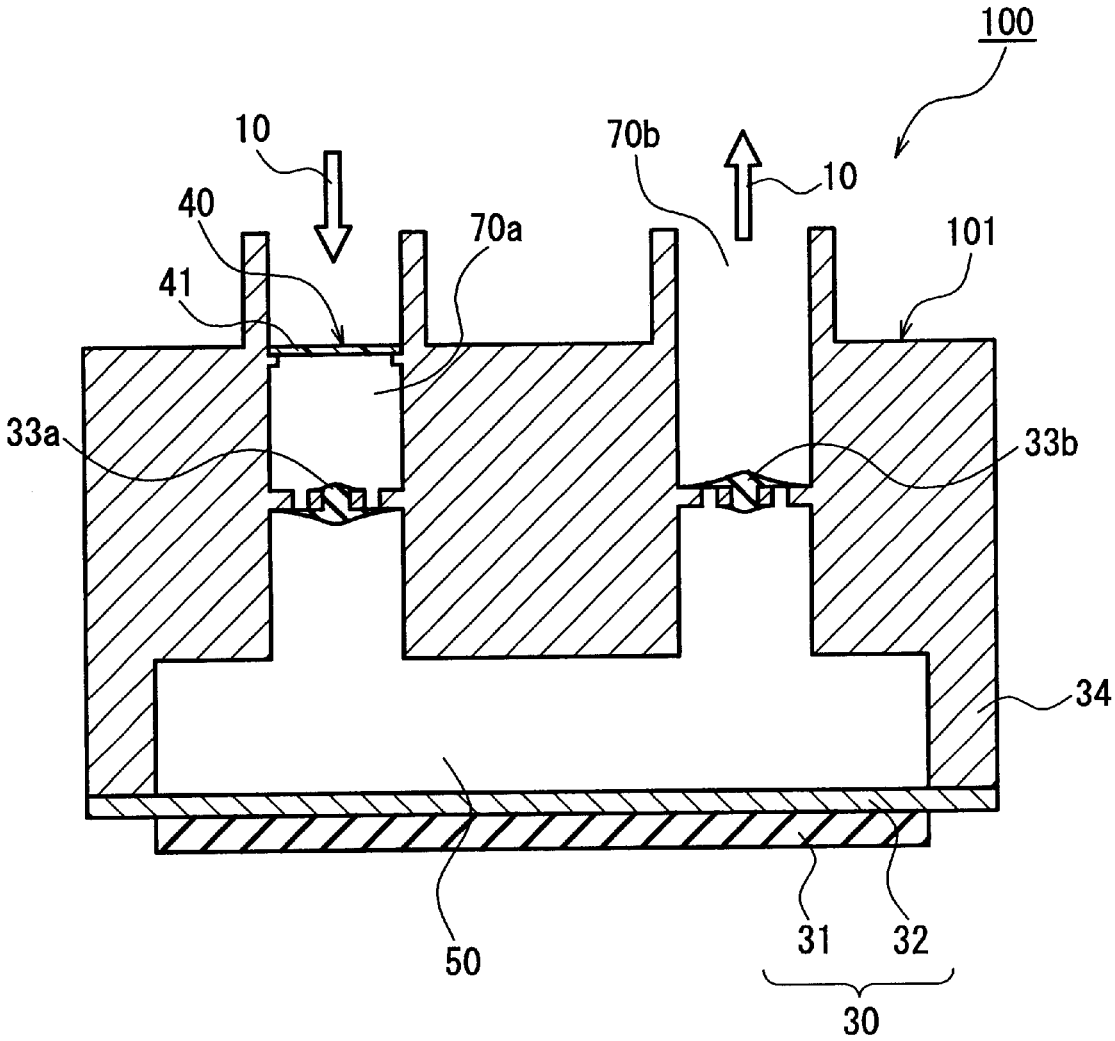
FIG. 1 is a schematic sectional view showing a miniature pump according to a first embodiment of the present invention.

In order to increase a discharge flow rate of a diaphragm type miniature pump, the inventors attempted to extend a stroke of a diaphragm by utilizing a resonance of the diaphragm for driving.

However, when utilizing the resonance of the diaphragm, the presence of air bubbles in the pump was found to have a greater influence compared with the case of a conventional diaphragm pump using a motor. In other diaphragm type pumps utilizing no resonance, it also was found that the presence of air bubbles changed characteristics. Thus, considering that it might be possible to achieve a large discharge flow rate and stabilize discharge flow rate characteristics by preventing the entry of air bubbles into the pump, the inventors conducted intensive studies and then completed the present invention.

Since a miniature pump of the present invention includes a bubble trap portion for blocking an entry of air bubbles into a miniature pump portion, the air bubbles do not enter the miniature pump portion. As a result, it is possible to provide a miniature pump that achieves both a large discharge flow rate and stable discharge flow rate characteristics.

There is no particular limitation on the size of the miniature pump portion of the present invention. However, it is preferable that the miniature pump portion has a size that can be incorporated in portable equipment. More specifically, it is preferable that at least one of the height, width and depth dimensions thereof does not exceed 40 mm. Although its flow rate is not particularly limited either, it is preferable that the maximum flow rate is not greater than about $1\times10^{-3}$ $m^3$/min.

It is preferable that the miniature pump portion further includes a liquid delivery mechanism for allowing the liquid to flow in through the suction passage and to be discharged through the discharge passage.

Also, it is preferable that the miniature pump portion further includes a pressure chamber provided between the suction passage and the discharge passage, a movable member that is reciprocated so as to change a volume of the pressure chamber, a suction valve for preventing the liquid, which has flowed in from the suction passage to the pressure chamber, from flowing back to the suction passage, and a discharge valve for preventing the liquid, which has flowed out from the pressure chamber to the discharge passage, from flowing back to the pressure chamber.

In this case, it is preferable that the movable member is reciprocated by a piezoelectric actuator having a vibrating plate. This makes it easier to achieve a miniature pump with a small outer shape.

Also, in the above-described miniature pump, it is preferable that the bubble trap portion includes a filter. This makes it possible to achieve easily and inexpensively a bubble trap portion for blocking the entry of air bubbles into the miniature pump portion.

Furthermore, in the above-described miniature pump, it is preferable that the bubble trap portion includes one or more filters and a bubble reservoir. The presence of the bubble reservoir makes it possible to suppress a characteristic degradation of the bubble trap portion, which is caused by air bubbles being trapped by a filter and then attached to this filter, and a resulting characteristic degradation of the miniature pump.

In this case, it is preferable that the filters are provided in each of a suction port and a discharge port of the bubble reservoir. In this way, once the air bubbles are trapped in the bubble reservoir, they do not flow back even when the operation of the miniature pump is stopped. Therefore, it is possible to provided a miniature pump that can be operated constantly in a stable manner.

It is preferable that the filters provided in each of the suction port and the discharge port of the bubble reservoir have different characteristics. This makes it possible to trap the air bubbles reliably in the bubble reservoir between these filters.

Moreover, in the above-described miniature pump, the miniature pump portion and the bubble trap portion may be formed as one piece. This makes it possible to prevent an increase in the number of components, thus providing a miniature pump that can be installed and handled easily.

Alternatively, in the above-described miniature pump, the miniature pump portion and the bubble trap portion may be in communication with each other via a pipe. This enhances the degree of flexibility in arranging the miniature pump portion and the bubble trap portion.

Also, in the above-described miniature pump, it is preferable that the bubble trap portion is provided on a side of the suction passage. This makes it possible to prevent the entry of air bubbles into the miniature pump portion reliably.

In the case where the bubble trap portion is constituted by one or more filters and a bubble reservoir, it is preferable that at least one of the filters serves as an inner surface of the bubble reservoir, and $X\leqq(2\sigma/\rho g)^{1/2}$ is satisfied where X is a distance between the one of the filters serving as the inner surface and an inner surface of the bubble reservoir opposed thereto, $\sigma$ is a surface tension of a liquid to be used, $\rho$ is a density thereof and g is a gravitational acceleration. This makes it possible to provide a miniature pump with less change in characteristics depending on the orientation of the bubble trap portion.

Next, a cooling system of the present invention includes the above-described miniature pump of the present invention, an internal heat exchanger unit, an external heat exchanger unit, and a pipe for connecting the miniature pump, the internal heat exchanger unit and the external heat exchanger unit. Since the miniature pump of the present invention is used as a pump, a miniature cooling system having a stable and high cooling power can be achieved.

In this case, the bubble trap portion can be arranged as at least a part of one or both of the internal heat exchanger unit and the external heat exchanger unit. The bubble trap portion may be received in the internal heat exchanger unit and/or the external heat exchanger unit, thereby reducing the number of components.

Alternatively, the bubble trap portion may be at least one of the internal heat exchanger unit and the external heat exchanger unit. This makes it possible to reduce the number of components and miniaturize the cooling system. Furthermore, the bubble trap portion is expanded, thereby improving a bubble trapping performance.

Also, it is preferable that a passage wall downstream of the bubble trap portion serves as a heat-absorbing surface of the internal heat exchanger unit or a heat-dissipating surface of the external heat exchanger unit. This makes it possible to obtain high heat exchanging characteristics in a stable manner.

Furthermore, a portable equipment of the present invention includes the above-described cooling system of the present invention. Accordingly, since a cooling and heat-dissipating power of a heat-generating portion improves even in a miniature cooling system, a miniature high-performance portable equipment can be provided.

It is preferable that the above-described portable equipment of the present invention further includes a heat-generating portion, and the heat-generating portion contacts the internal heat exchanger unit. This improves and stabilizes a heat-absorbing effect of the heat-generating portion.

Also, in the case where the portable equipment includes at least two heat-generating portions, it is preferable that at least two of the internal heat exchanger units are provided, and the internal heat exchanger units respectively contact the at least two heat-generating portions. The internal heat exchanger units are provided according to a plurality of the heat-generating portions, thereby enhancing a degree of flexibility in arranging the heat-generating portions.

Moreover, it is preferable that the portable equipment includes a heat-generating portion, and a passage wall downstream of the bubble trap portion contacts the heat-generating portion. This makes it possible to obtain a high heat-absorbing effect in a stable manner.

Furthermore, it is preferable that a passage wall downstream of the bubble trap portion contacts a surface plate of a housing or serves as a part of a surface of the housing. This makes it possible to obtain a high heat-dissipating effect in a stable manner.

Hereinafter, the present invention will be described more specifically by way of embodiments.

First Embodiment

The following is a description of a first embodiment of the present invention, with reference to the accompanying drawings.

FIG. 1 is a schematic sectional view showing a miniature pump 100 according to the first embodiment of the present invention. The miniature pump 100 basically includes a miniature pump portion 101 and a bubble trap portion 40. The miniature pump portion 101 has a suction passage 70*a* through which liquid flows in, a discharge passage 70*b* through which liquid flows out, a pressure chamber 50 provided between the suction passage 70*a* and the discharge passage 70*b*, a piezoelectric vibrating plate (movable member) 30 that is reciprocated so as to change a volume of the pressure chamber 50, a suction valve 33*a* provided in an inflow passage to the pressure chamber 50, and a discharge valve 33*b* provided in an outflow passage from the pressure chamber 50. The suction valve 33*a* prevents the liquid, which has flowed from the suction passage 70*a* to the pressure chamber 50, from flowing back to the suction passage 70*a*, and the discharge valve 33*b* prevents the liquid, which has flowed from the pressure chamber 50 to the discharge passage 70*b*, from flowing back to the pressure chamber 50. Further, the bubble trap portion 40 includes a filter 41 provided in the suction passage 70*a*. The miniature pump portion 101 and the bubble trap portion 40 are formed as one piece by a casing 34. In FIG. 1, arrows 10 indicate liquid flow directions.

More specifically, the piezoelectric vibrating plate 30, which is a diaphragm (movable member), is constituted by a ceramic substrate serving as a piezoelectric substrate 31 and a stainless steel substrate serving as a vibrating plate 32 attached to one side of this ceramic substrate. Both of the suction valve 33*a* and the discharge valve 33*b* may be check valves made of resin. In addition, a sheet-like hydrophilic filter is used as the filter 41.

Next, an operation principle of this piezoelectric vibrating plate 30 will be described using FIGS. 2A and 2B.

Figure 2A:
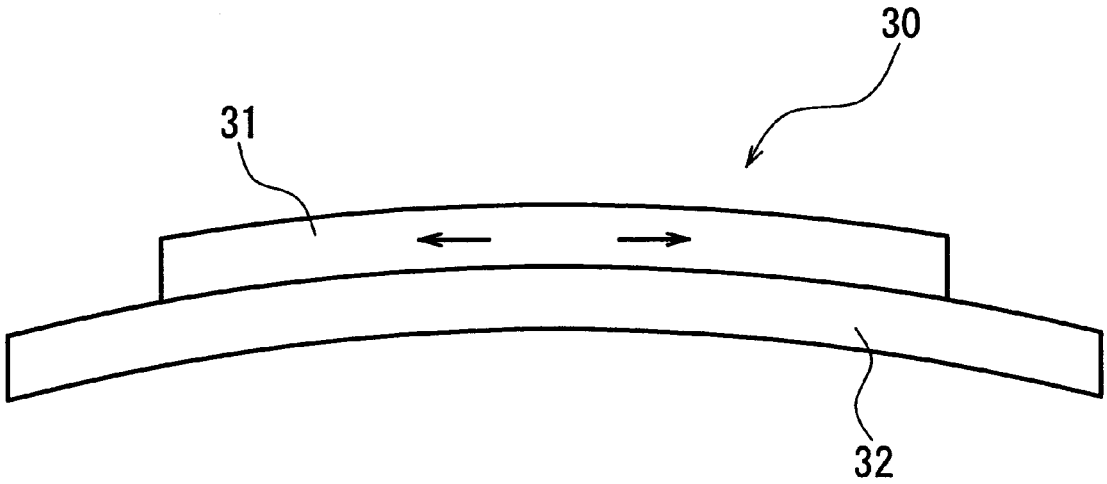
FIGS. 2A and 2B both illustrate an operation of a piezoelectric vibrating plate.
Figure 2B:
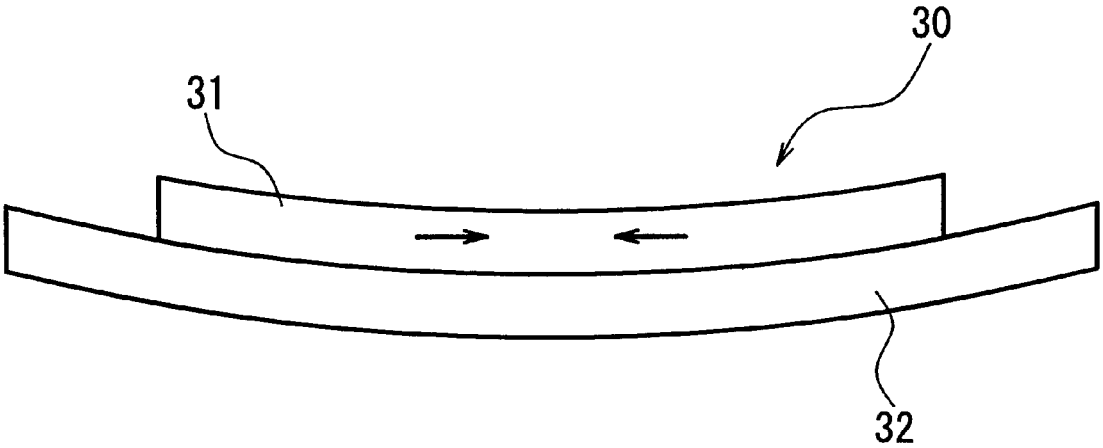

FIGS. 2A and 2B are enlarged views showing the piezoelectric vibrating plate 30. The piezoelectric substrate (piezoelectric element) 31 constituting this piezoelectric vibrating plate 30 has a property of extending and contracting in a longitudinal direction of the substrate when a pulse voltage is applied to a thickness direction of the substrate (see arrows in the figures). Thus, by attaching the piezoelectric substrate 31 to the vibrating plate 32, it becomes possible to cause a bending displacement as shown in FIG. 2A or 2B. For example, an application of a positive pulse voltage causes the piezoelectric substrate 31 to extend and that of a negative pulse voltage causes the piezoelectric substrate 31 to contract, so that upward and downward bending displacements occur as shown in FIGS. 2A and 2B, respectively. Such a bending displacement of the piezoelectric vibrating plate 30 changes the volume inside the pressure chamber 50, thus compressing and decompressing the liquid in the pressure chamber 50. Due to these compressing and decompressing operations and the function of the valves 33*a* and 33*b*, the pump conveys the liquid in one direction. In the following, the pump operation will be explained in detail.

The bending displacement of the piezoelectric vibrating plate 30 decompresses the pressure chamber 50, thus opening the suction valve 33*a* provided on the side of the suction passage 70*a* and closing the discharge valve 33*b* provided on the side of the discharge passage 70*b*, so that the liquid flows from the suction passage 70*a* into the pressure chamber 50. Thereafter, the bending displacement of the piezoelectric vibrating plate 30 toward the opposite direction compresses the pressure chamber 50, thus closing the suction valve 33*a* provided on the side of the suction passage 70*a* and opening the discharge valve 33*b* provided on the side of the discharge passage 70*b*, so that the liquid flows out from the pressure chamber 50 to the discharge passage 70*b*. These operations are repeated successively, thereby achieving the pump operation.

The filter 41 as the bubble trap portion 40 is provided in the suction passage 70*a*, so that, among the liquid entraining air bubbles, only the liquid passes through micropores of the filter 41, while the bubbles are trapped by the filter 41. Thus, it is possible to prevent the air bubbles from entering from the suction passage 70*a* to the pressure chamber 50. An example of the filter 41 includes a hydrophilic filter such as a membrane filter manufactured by Millipore Corporation (for example, trade name "Mitex LC" (made of PTFE (polytetrafluoroethylene), having a pore diameter of 10 $\mu$m) or trade name "Durapore SVLP" (made of PVDF (polyvinylidene fluoride), having a pore diameter of 5 $\mu$m). Incidentally, there is no particular limitation on the filter, and a filter having a larger pore diameter (for example, 30 $\mu$m, 50 $\mu$m, etc.) may be used instead of the above-described filter.

Figure 3:
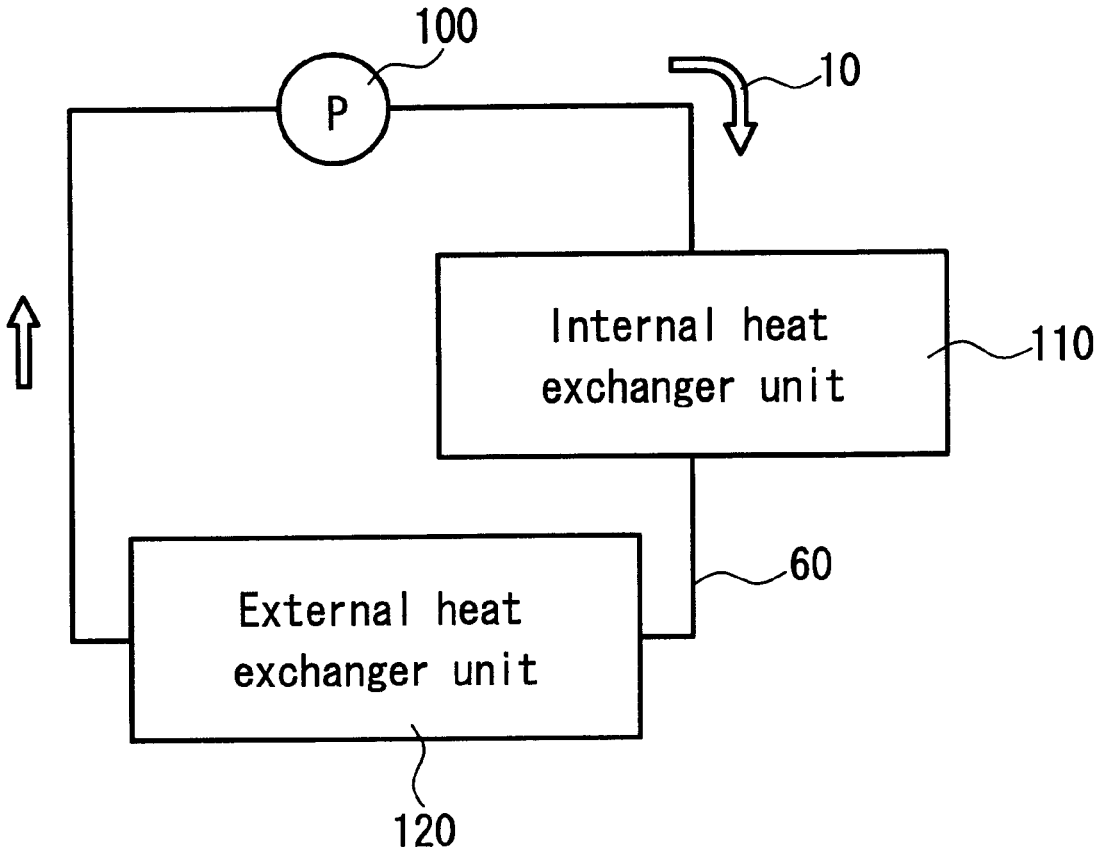
FIG. 3 is a schematic diagram of a cooling system using the miniature pump according to the first embodiment of the present invention.

Next, a cooling system using this pump will be described referring to FIG. 3.

The cooling system mainly includes the miniature pump 100, an internal heat exchanger unit 110, an external heat exchanger unit 120 and a pipe 60 connecting these components.

The operation of the cooling system will be explained briefly. The miniature pump 100 circulates the liquid in the pipe 60. The internal heat exchanger unit 110 absorbs heat from heat-generating components, for example, a CPU (central processing unit) of a personal computer so as to raise a liquid temperature, while the external heat exchanger unit 120 releases heat, which has been absorbed into the liquid, in the air so as to lower the liquid temperature. By repeating this operation, the cooling system can function so as to suppress a temperature increase in heat-generating components such as a CPU.

In accordance with the present embodiment described above, the vibration of the piezoelectric vibrating plate 30 gives the liquid in the pressure chamber 50 a vibrational energy (pressure), which pushes the suction valve 33*a* and the discharge valve 33*b* open so as to perform the pump operation. Accordingly, pulsations are generated, so that this gives the miniature pump portion 101 resonant characteristics with respect to its discharge flow rate. By utilizing such resonant characteristics, it becomes possible to increase a flow rate, achieving a miniature pump with a large flow rate. Furthermore, since the bubble trap portion 40 is provided in the suction passage, the air bubbles do not enter the miniature pump portion 101. As a result, it is possible to prevent a phenomenon in which air bubbles present in the miniature pump portion 101 change the frequency characteristics of the pump considerably and thus change the flow rate considerably, and a phenomenon in which the pump operation stops when many air bubbles are present in the pump.

Also, when using the pump in the cooling system, the presence of the bubble trap portion 40 allows the pipe to be selected freely. This is because air bubbles entering from a pipe material can be trapped by the bubble trap portion 40, thus preventing the entry of air bubbles into the miniature pump portion 101.

Furthermore, it becomes easier to introduce a pipe joint system, which is important in simplifying a system assembly, leading to higher productivity.

In addition, a liquid deaerating process, which is needed usually when using the pump in the cooling system, can be eliminated, thereby improving the productivity further.

Although the cooling system includes only the pump 100, the internal heat exchanger unit 110, the external heat exchanger unit 120 and the pipe 60 connecting these components in the present embodiment, it further may be provided with, for example, a hinge portion for allowing bending or a flowmeter, in which case a similar effect can be obtained.

Although a hydrophilic filter is used as the bubble trap portion 40 in the present embodiment, there is no particular limitation on the pore diameter and material thereof. The similar effect can be produced as long as the structure prevents air bubbles from entering the miniature pump portion 101. For example, a metal mesh (for instance, a twilled dutch weave stainless-steel mesh with a mesh number of 165×800 and a filtration precision of about 30 to 32 $\mu$m) may be used.

Furthermore, although check valves made of resin are used as the valves 33*a* and 33*b*, the present invention is not limited thereto. For example, a valve formed of stainless steel also can produce the similar effect as long as it has a valve mechanism.

Moreover, although a piezoelectric vibrating plate having a piezoelectric substrate as a driving source of the diaphragm is used, the present invention is not limited to this. A similar effect can be achieved by replacing the diaphragm with, for example, a piston as long as it can change the volume of the pressure chamber 50.

In addition, although the above description is directed to an example of using a reciprocating pump, which is a positive-displacement pump, as a liquid delivery mechanism of the miniature pump portion 101, not only the reciprocating pump but also a turbopump such as a rotary pump, a centrifugal pump or an axial-flow pump can be used. By providing the bubble trap portion 40, the similar effect can be produced.

Second Embodiment

The following is a description of a second embodiment of the present invention, with reference to the accompanying drawings.

Figure 4:
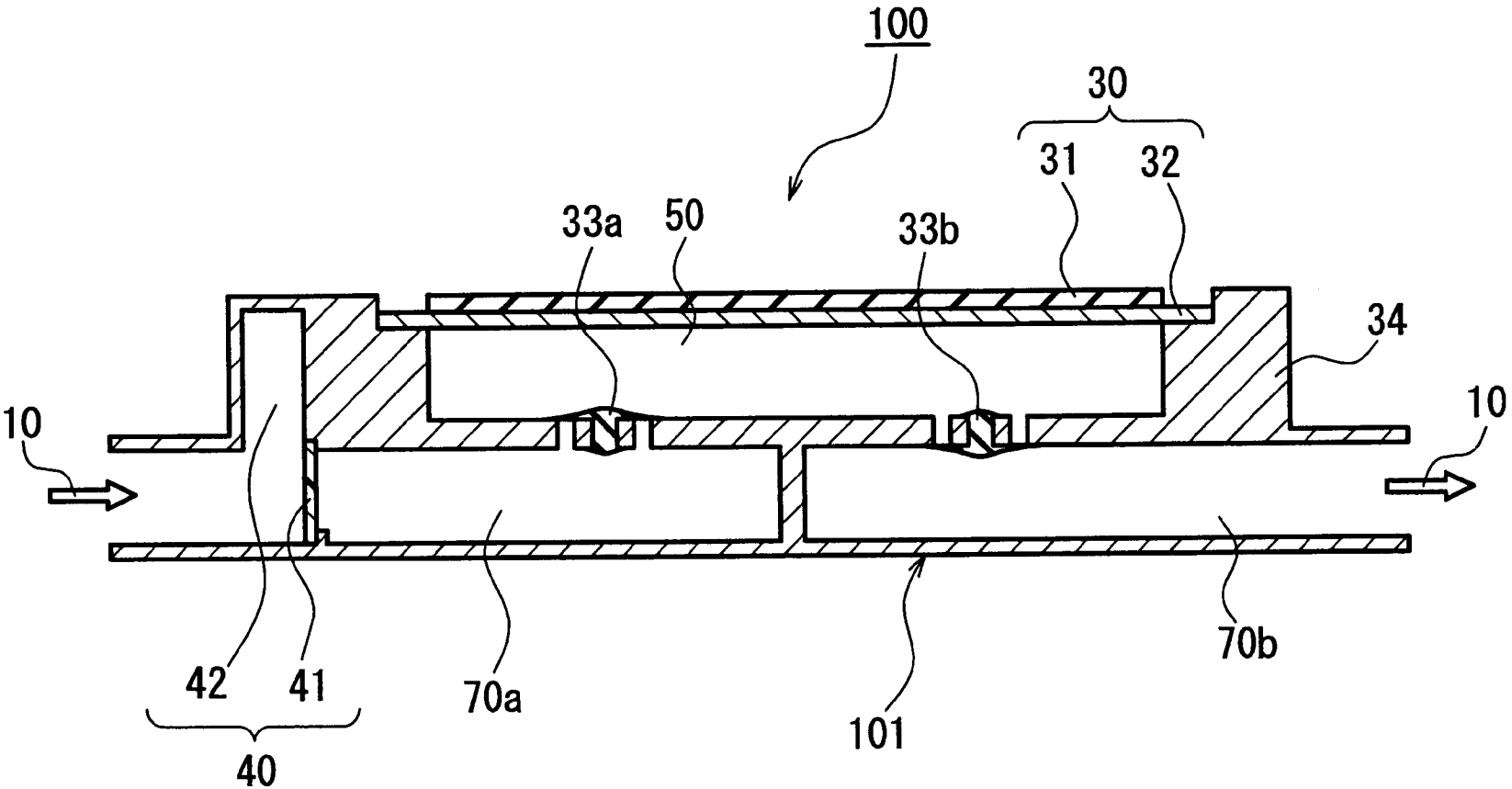
FIG. 4 is a schematic sectional view showing a miniature pump according to a second embodiment of the present invention.

FIG. 4 is a schematic sectional view showing a miniature pump 100 according to the second embodiment of the present invention. In this figure, members having a function similar to that of FIG. 1 are given the same numerals. The present embodiment is different from the first embodiment in that the bubble trap portion 40 is constituted by a filter 41 and a bubble reservoir 42 upstream of the filter 41.

In accordance with the present embodiment described above, an effect similar to the first embodiment can be obtained. In other words, the bubble trap portion 40 is provided on the side of the suction passage 70*a* of the miniature pump portion 101, thereby preventing the entry of air bubbles into the pressure chamber 50, so that the characteristics of the miniature pump portion 101 do not change and the operation does not stop.

Furthermore, by providing the bubble reservoir 42 as a part of the bubble trap portion 40, air bubbles trapped by the filter 41 rise and gather in the bubble reservoir 42, thereby preventing the air bubbles from staying on the surface of the filter 41. Therefore, it becomes possible to alleviate a characteristic degradation of the filter 41, which is due to a decrease in an effective filter area caused by air bubbles generated in large amounts and then attached to the surface of the filter 41, and a resulting degradation of pump performance.

In the present embodiment, the bubble reservoir 42 is located above the filter 41. This is because the downward direction of the sheet of drawing is assumed to be a direction of gravity. The similar characteristics can be obtained by changing the orientation of the bubble reservoir depending on the direction in which the pump is disposed.

Also, it is assumed that the miniature pump 100 is oriented toward only one direction in FIG. 4. However, when there are two or more orientation directions, the similar effect can be obtained by devising the shape of the bubble reservoir or providing a plurality of bubble reservoirs in accordance with the orientation directions.

In addition, although a hydrophilic filter is used as the filter 41 in the present embodiment as in the first embodiment, the present invention is not limited to this. For example, a metal mesh also may be used. Alternatively, the filter 41 does not have to be provided. The similar effect can be obtained as long as the structure prevents the entry of air bubbles into the miniature pump portion 101.

Furthermore, although check valves made of resin are used as the valves 33*a* and 33*b*, the present invention is not limited thereto. For example, a valve formed of stainless steel also can produce the similar effect as long as it has a valve mechanism.

Moreover, although a piezoelectric vibrating plate having a piezoelectric substrate as a driving source of the diaphragm is used, the present invention is not limited to this. A similar effect can be produced by replacing the diaphragm with, for example, a piston as long as it can change the volume of the pressure chamber 50.

In addition, although the above description is directed to an example of using a reciprocating pump, which is a positive-displacement pump, as a liquid delivery mechanism of the miniature pump portion 101, not only the reciprocating pump but also a turbopump such as a rotary pump, a centrifugal pump or an axial-flow pump can be used. By providing the bubble trap portion 40, the similar effect can be produced.

Third Embodiment

The following is a description of a third embodiment of the present invention, with reference to the accompanying drawings.

Figure 5:
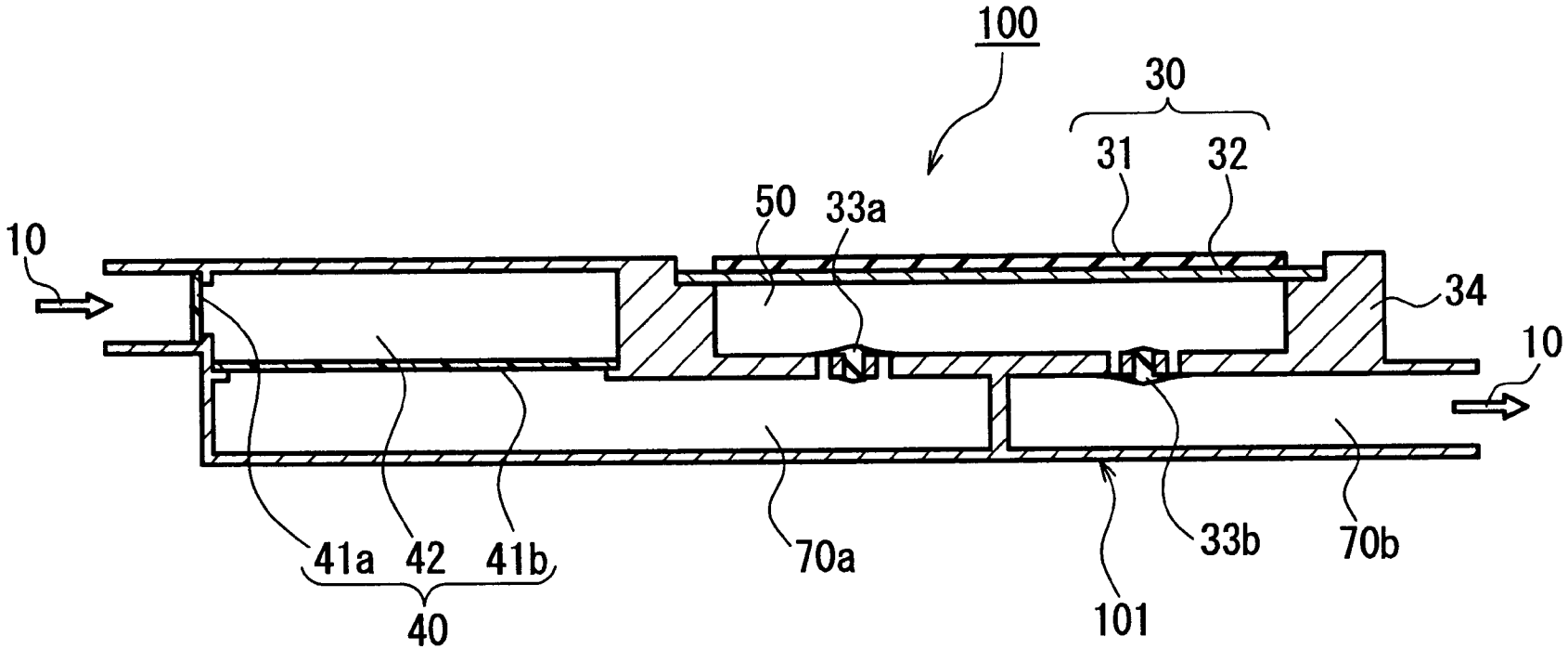
FIG. 5 is a schematic sectional view showing a miniature pump according to a third embodiment of the present invention.

FIG. 5 is a schematic sectional view showing a miniature pump 100 according to the third embodiment of the present invention. In this figure, members having a function similar to that of FIG. 1 are given the same numerals. The present embodiment is different from the first embodiment in that the bubble trap portion 40 is constituted by a first filter 41*a*, a second filter 41*b* and a bubble reservoir 42. The liquid flowing into the pressure chamber 50 passes through the first filter 41*a*, the bubble reservoir 42 and the second filter 41*b* in this order.

Next, the characteristics of the first filter 41*a* and the second filter 41*b* will be described in detail referring to FIG. 6.

Figure 6:
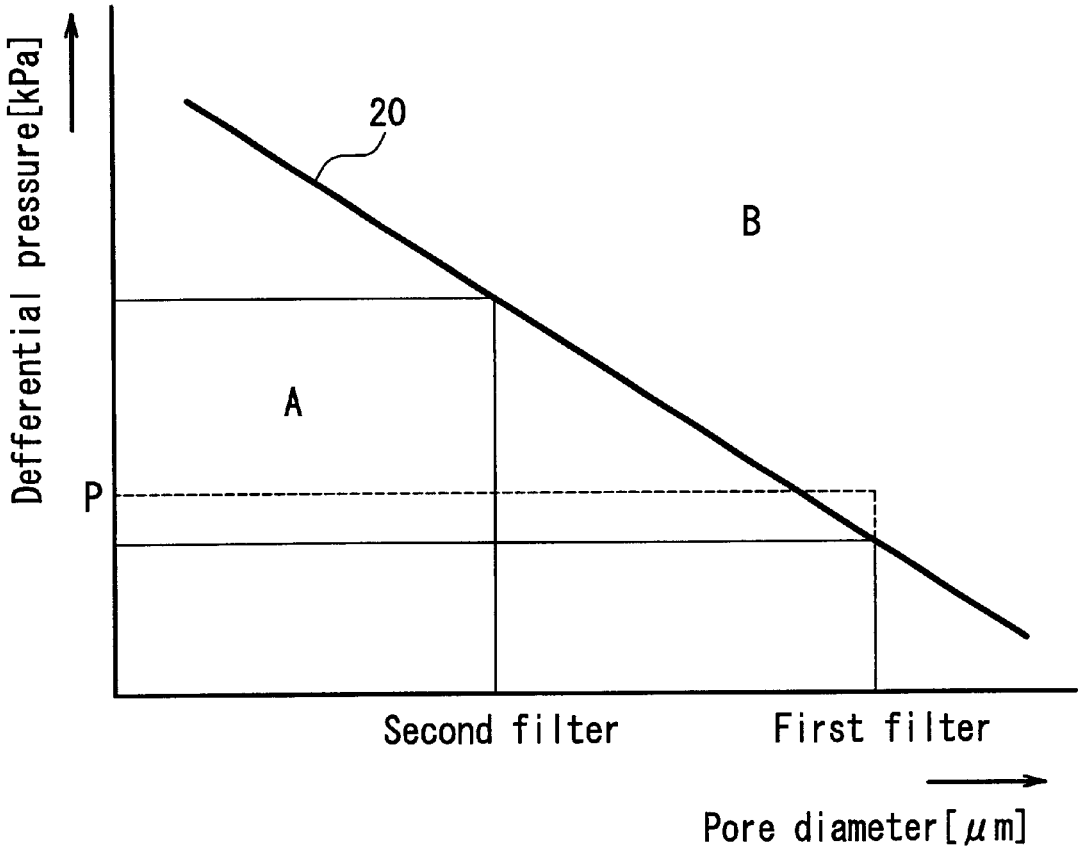
FIG. 6 is a graph for describing the characteristics of a filter constituting a bubble trap portion of the miniature pump according to the third embodiment of the present invention.

In FIG. 6, the ordinate indicates a differential pressure of liquids on the front and back sides of the filter, and the abscissa indicates a pore diameter (an opening diameter) of the filter. In the state where liquid is filled on both sides of the filter having a predetermined pore diameter and air bubbles are mixed only in one side, the pressure on the side where the air bubbles are present is raised gradually with respect to the other side. Then, the differential pressure between the front and back sides of the filter at the time these air bubbles start passing through filter pores is indicated by a thick solid line 20 in FIG. 6. As shown in this figure, when the pore diameter of the filter is large, the air bubbles pass through the filter pores even under a small pressure. Thus, the air bubbles cannot pass through the filter under the pore diameter and differential pressure conditions shown by a region A closer to the origin point with respect to the thick solid line 20 of FIG. 6, while the air bubbles can pass through the filter under the pore diameter and differential pressure conditions shown by a region B on the other side of the thick solid line 20.

In FIG. 6, the differential pressure "P" indicates a differential pressure on the front and back sides of each of the filters 41*a* and 41*b* when the pressure chamber 50 is in a decompressed state. Although the differential pressures for these filters are different in reality when the pressure chamber 50 is in the decompressed state, they are indicated by the same differential pressure P in FIG. 6 for simplicity.

The first filter 41*a* is provided upstream of the bubble reservoir 42, and its pore diameter is designed to correspond to the position indicated by "First filter" in FIG. 6. Thus, when the miniature pump is driven so that the differential pressure P acts on both sides of the first filter 41*a*, the first filter 41*a* passes air bubbles. On the other hand, it does not pass air bubbles when the miniature pump is at rest, in other words, when the differential pressure is substantially zero, which means that the air bubbles in the bubble reservoir 42 cannot flow back.

On the other hand, the second filter 41*b* is provided downstream of the bubble reservoir 42, and its pore diameter is designed to correspond to the position indicated by "Second filter" in FIG. 6. Thus, the second filter 41*b* does not pass air bubbles even when the miniature pump is driven so that the differential pressure P acts on both sides of the second filter 41*b*.

As described above, the first filter 41*a* and the second filter 41*b* have different characteristics. Furthermore, it is preferable that each of these filters 41*a* and 41*b* individually has a small pressure loss.

In the present embodiment, for the purpose of providing such characteristics, a stainless steel mesh is used as the first filter 41*a* and a hydrophilic filter is used as the second filter 41*b*.

In accordance with the present embodiment described above, an effect similar to the first embodiment can be obtained.

Furthermore, since the bubble trap portion 40 is constituted by the first filter 41*a*, the second filter 41*b* and the bubble reservoir 42, air bubbles that have passed through the first filter 41*a* and then flowed into the bubble reservoir 42 neither pass through the second filter 41*b* and flow into the pressure chamber 50, nor pass through the first filter 41*a* and the second filter 41*b* even when the miniature pump is at rest. Therefore, air bubbles once trapped in the bubble reservoir 42 do not leak out even if vibrations are applied while the miniature pump 100 is at rest, and a stable operation can be assured also at the resumption of pump operation thereafter.

Moreover, when the miniature pump 100 used in the present embodiment is used as a part of a circulating system, since all the air bubbles generated in the system are collected in the bubble reservoir 42 of the bubble trap portion 40, it becomes easier to do maintenance, for example, keep track of the amount of liquid inside and recharge liquid.

Although the present embodiment uses a stainless steel mesh and a hydrophilic filter as the filters 41*a* and 41*b*, there is no limitation to these. A similar effect can be obtained as long as a filter showing characteristics generally indicated by FIG. 6 is adopted.

Also, although check valves made of resin are used as the valves 33*a* and 33*b*, the present invention is not limited thereto. For example, a valve formed of stainless steel also can produce the similar effect as long as it has a valve mechanism.

Moreover, although a piezoelectric vibrating plate having a piezoelectric substrate as a driving source of the diaphragm is used, the present invention is not limited to this. A similar effect can be produced by replacing the diaphragm with, for example, a piston as long as it can change the volume of the pressure chamber 50.

In addition, although the above description is directed to an example of using a reciprocating pump, which is a positive-displacement pump, as a liquid delivery mechanism of the miniature pump portion 101, not only the reciprocating pump but also a turbopump such as a rotary pump, a centrifugal pump or an axial-flow pump can be used. By providing the bubble trap portion 40, the similar effect can be produced.

Fourth Embodiment

The following is a description of a fourth embodiment of the present invention, with reference to the accompanying drawings.

Figure 7:
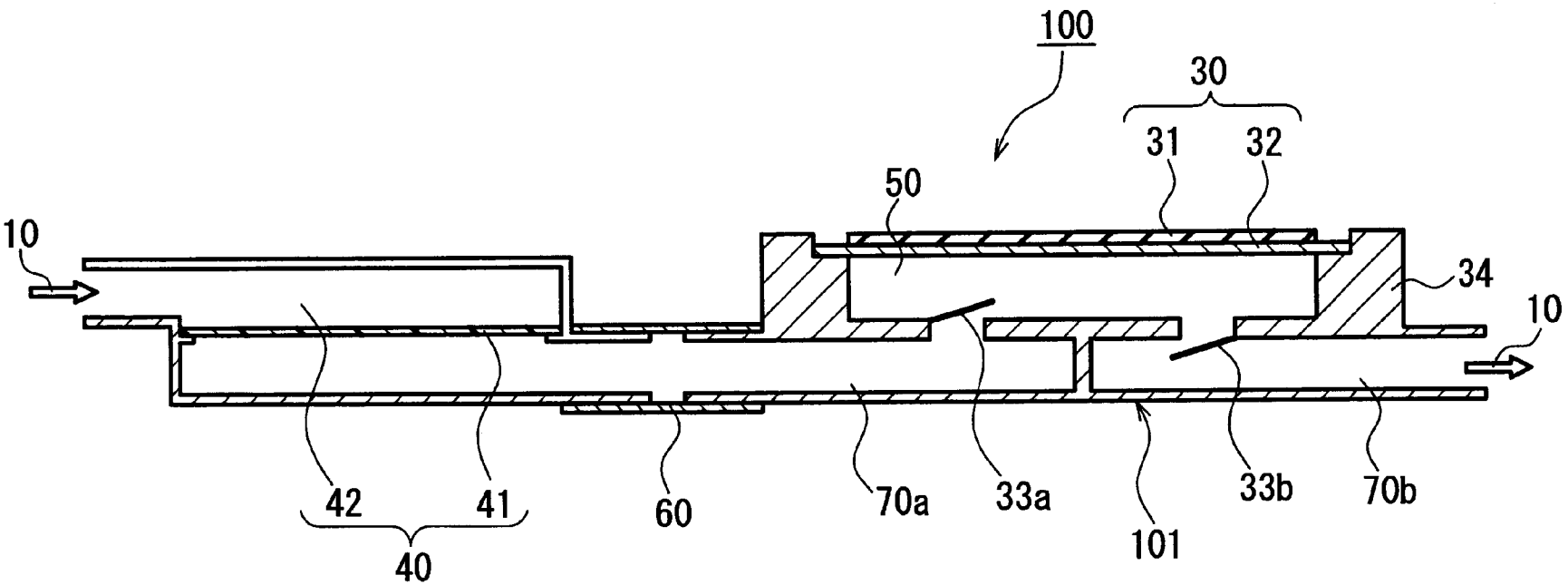
FIG. 7 is a schematic sectional view showing a miniature pump according to a fourth embodiment of the present invention.

FIG. 7 is a schematic sectional view showing a miniature pump 100 according to the fourth embodiment of the present invention. In this figure, members having a function similar to that of FIG. 1 are given the same numerals. The present embodiment is different from the first embodiment in that the bubble trap portion 40 is constituted by a filter 41 and a bubble reservoir 42 upstream of the filter 41 as in the second embodiment, and that this bubble trap portion 40 and the miniature pump portion 101 are separated and they are in communication (connection) with each other via a pipe 60. In addition, valve mechanisms formed of stainless steel are used instead of check valves as the suction valve 33*a* and the discharge valve 33*b* in the present embodiment.

In accordance with the present embodiment described above, an effect similar to the second embodiment can be obtained since the bubble trap portion 40 is constituted as in the second embodiment.

Furthermore, by separating the bubble trap portion 40 and the miniature pump portion 101 so as to be in communication via the pipe 60 instead of forming them as one piece by the common casing 34, it becomes possible to arrange the bubble trap portion 40 freely, thus improving a degree of design flexibility and functionality in constituting the system using the miniature pump. The pipe 60 can be designed to have any length, and it may be bent or have its midway position provided with a flowmeter or a hinge portion allowing folding freely.

Although a piezoelectric vibrating plate having a piezoelectric substrate as a driving source of the diaphragm is used in the present embodiment, the present invention is not limited to this. A similar effect can be produced by replacing the diaphragm with, for example, a piston as long as it can change the volume of the pressure chamber 50.

In addition, although the above description is directed to an example of using a reciprocating pump, which is a positive-displacement pump, as a liquid delivery mechanism of the miniature pump portion 101, not only the reciprocating pump but also a turbopump such as a rotary pump, a centrifugal pump or an axial-flow pump can be used. By providing the bubble trap portion 40, the similar effect can be produced.

Although the above description is directed to an example in which the bubble trap portion 40 has a configuration similar to that in the second embodiment, a bubble trap portion also can have a configuration similar to that in the third embodiment. Furthermore, as long as air bubbles are trapped by the bubble trap portion 40 and prevented from passing through the pipe 60 and entering the miniature pump 100, the filter 41 does not have to be provided. Alternatively, the bubble trap portion 40 may include no bubble reservoir as in the first embodiment.

Fifth Embodiment

The following is a description of a fifth embodiment of the present invention, with reference to the accompanying drawings.

Figure 8:
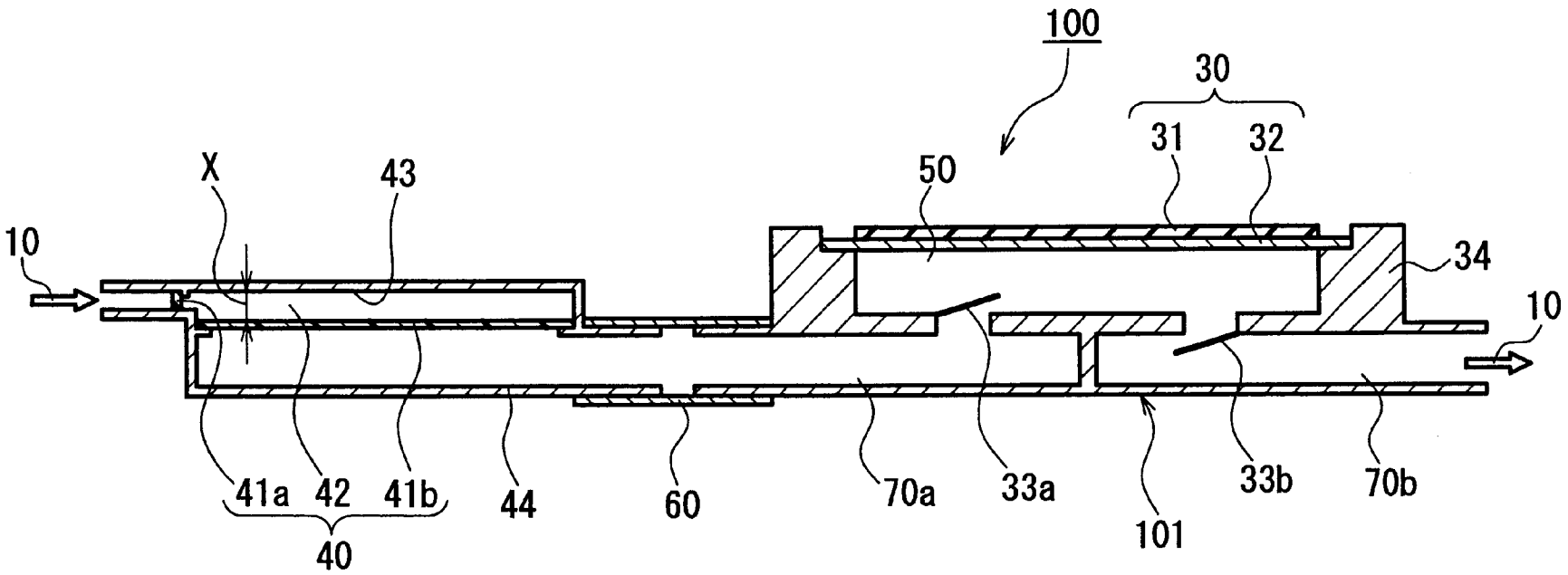
FIG. 8 is a schematic sectional view showing a miniature pump according to a fifth embodiment of the present invention.
Figure 9:
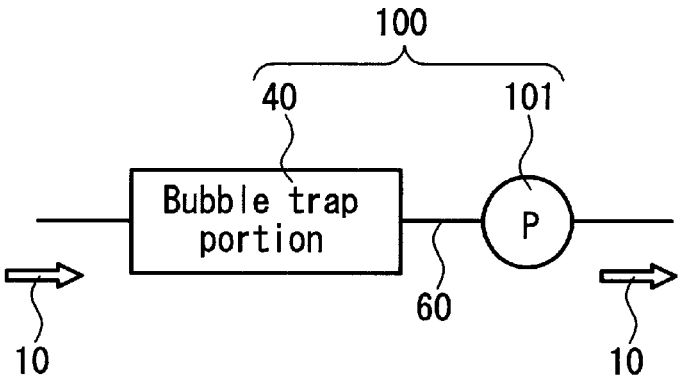
FIG. 9 is a schematic diagram of a miniature pump shown in FIG. 8.

FIG. 8 is a schematic sectional view showing a miniature pump 100 according to the fifth embodiment of the present invention. In this figure, members having a function similar to that of FIG. 1 are given the same numerals. FIG. 9 is a structural diagram of this miniature pump 100. The present embodiment is different from the first embodiment in the following manner. The bubble trap portion 40 is constituted by the first filter 41*a*, the second filter 41*b* and the bubble reservoir 42 as in the third embodiment. The bubble trap portion 40 and the miniature pump portion 101 are in communication with each other via the pipe 60 as in the fourth embodiment. In addition, as in the fourth embodiment, valve mechanisms formed of stainless steel are used instead of check valves as the suction valve 33*a* and the discharge valve 33*b*.

The bubble reservoir 42 of the bubble trap portion 40 in the present embodiment forms a substantially rectangular parallelepiped space, whose one side corresponds to the second filter 41*b*. The distance X between the second filter 41*b* and an inner wall surface 43 opposed thereto satisfies $X \leqq (2\sigma/\rho g)^{1/2}$ where $\sigma$ is a surface tension of a liquid to be used, $\rho$ is a density thereof and g is a gravitational acceleration.

The following is a specific example of the bubble trap portion 40 of the present embodiment. When a liquid to be discharged by the miniature pump 100 is water, since the surface tension $\sigma$ of water is 73 mN/m, the density $\rho$ thereof is 998 kg/m$^3$ and the gravitational acceleration g is 9.8 m/s$^2$, $(2\sigma/\rho g)^{1/2}$ is 3.9 mm. Accordingly, it is appropriate that the distance X between the second filter 41*b* of the bubble trap portion 40 and its opposing surface 43 be not greater than 3.9 mm. Thus, the above-described distance (thickness) X of the bubble reservoir 42 was set to be 3 mm in this example of the present embodiment.

Next, a cooling system using this pump will be described referring to FIG. 10. In this figure, members having a function similar to that of FIG. 3, which shows the cooling system according to the first embodiment, are given the same numerals.

This cooling system is different from the cooling system described in the first embodiment (see FIG. 3) in that the miniature pump portion 101 and the bubble trap portion 40 are in communication with each other via the pipe 60.

In accordance with the present embodiment described above, since the bubble trap portion 40 is constituted by the first filter 41*a*, the second filter 41*b* and the bubble reservoir 42 as in the third embodiment, an effect similar to the third embodiment can be obtained.

Furthermore, by setting the distance X in the bubble reservoir 42 of the bubble trap portion 40 to be not greater than $(2\sigma/\rho g)^{1/2}$, air bubbles that have entered the bubble reservoir 42 move while being kept in contact with both the surface of the second filter 41*b* and the opposing inner wall surface 43 of the bubble trap portion 40. Therefore, the similar characteristics can be obtained regardless of how the miniature pump 100 (in particular, the bubble trap portion 40) is oriented. If the distance X is greater than $(2\sigma/\rho g)^{1/2}$, air bubbles might contact only one of the surface of the second filter 41*b* and the inner wall surface 43 depending on the orientation of the bubble trap portion 40. For example, when the bubble trap portion 40 is oriented in the direction in which the second filter 41*b* corresponds to the upper surface of the bubble reservoir 42, air bubbles in the bubble reservoir 42 gather near the surface of the second filter 41*b*, resulting in an increase in the pressure loss of the flowing liquid.

Although the above description is directed to an example in which the bubble reservoir 42 forms the substantially rectangular parallelepiped space, the present invention is not limited thereto. As long as the distance X between the surface of the second filter 41*b* provided on the outflow side of the bubble trap portion 40 and the inner wall surface 43 opposed thereto is not greater than $(2\sigma/\rho g)^{1/2}$, the space of the bubble reservoir 42 can have any shapes. For example, a projected shape of the bubble reservoir 42 seen in a normal direction of the surface of the second filter 41*b* may be a circular, elliptical, oblong-circular or any polygonal shape. In addition, the surface of the second filter 41*b* and the inner wall surface 43 opposed thereto preferably are parallel to each other, but they may be nonparallel as long as the distance X between them is not greater than $(2\sigma/\rho g)^{1/2}$. Also, one or both of them may include a curved surface instead of a flat surface. Furthermore, it is appropriate if, for the most part, the distance X between the surface of the second filter 41*b* and the inner wall surface 43 opposed thereto satisfy the above-mentioned relationship. Accordingly, for example, a part of the inner wall surface 43 may be provided with a recess whose distance from the surface of the second filter 41*b* is greater than $(2\sigma/\rho g)^{1/2}$.

The first filter 41*a* may be arranged so as to oppose the second filter 41*b*.

Furthermore, although the present embodiment is directed to the case where the bubble trap portion 40 is constituted by the first filter 41*a*, the second filter 41*b* and the bubble reservoir 42, the above-described design concept can be applied and a similar effect can be obtained also in the cases where the bubble trap portion 40 is constituted by the filter 41 and the bubble reservoir 42 upstream thereof as in the second embodiment (see FIG. 4) and the fourth embodiment (see FIG. 7). In such cases, it is appropriate that the bubble trap portion 40 be designed so that a surface opposing the filter 41 is arranged at a distance X from the filter 41 of not greater than $(2\sigma/\rho g)^{1/2}$.

Moreover, in accordance with the present embodiment, by bringing the bubble trap portion 40 and the miniature pump portion 101 into communication with each other via the pipe 60, it becomes possible to arrange the bubble trap portion 40 freely, thus improving a degree of design flexibility and functionality in constituting the system using the miniature pump.

Also, since the miniature pump portion 101 and the bubble trap portion 40 are brought into communication with each other using the pipe 60 to form the cooling system, the flexibility of the system improves.

Figure 10:
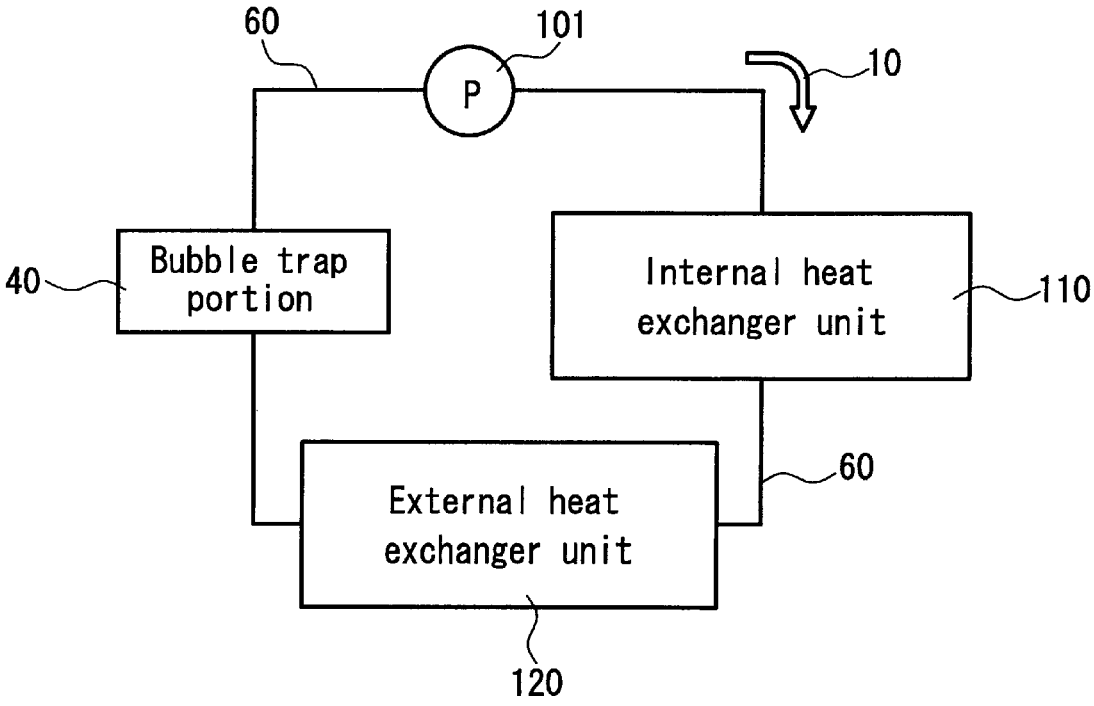
FIG. 10 is a schematic diagram of a cooling system using the miniature pump according to the fifth embodiment of the present invention.
Figure 11A:
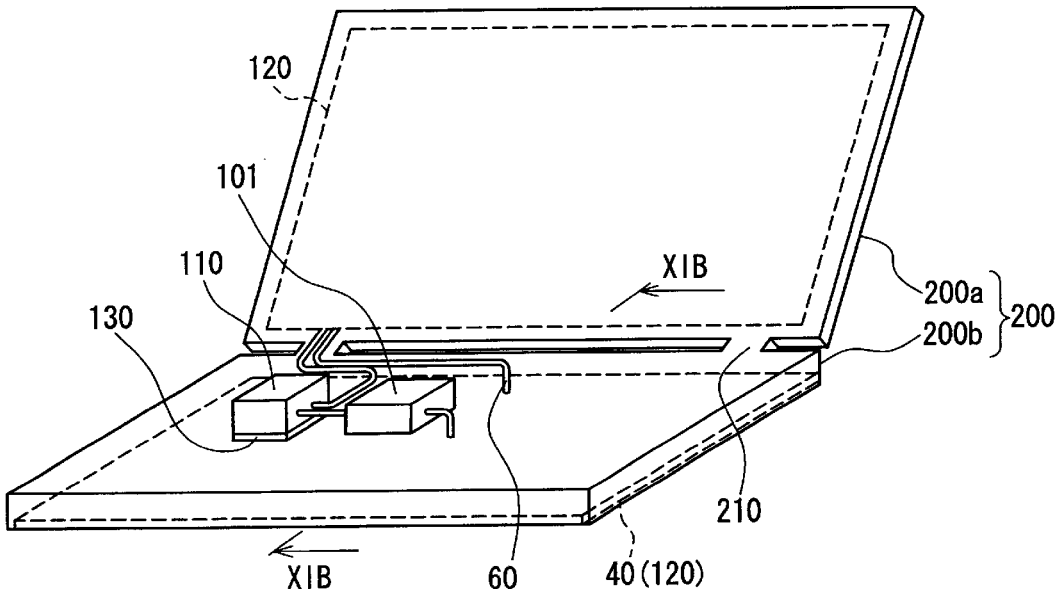
FIG. 11A is a perspective view showing a schematic configuration of portable equipment according to the fifth embodiment of the present invention.

FIG. 11A shows a structural example in the case where the cooling system of the present embodiment shown in FIG. 10 is applied to a notebook personal computer, which is an example of portable equipment. In FIG. 11A, numeral 200 indicates a housing of a personal computer and includes a first housing 200*a* in which a display panel (for example, a liquid crystal panel, not shown) is incorporated and a second housing 200*b* in which a keyboard and a circuit board (both not shown) are incorporated. The first housing 200*a* can be opened/closed with respect to the second housing 200*b* on a hinge 210. Numeral 130 indicates a heat-generating portion such as a central processing unit (CPU), which is in contact with an internal heat exchanger unit 110. The miniature pump portion 101, the internal heat exchanger unit 110, the heat-generating portion 130 and the bubble trap portion 40 are provided inside the second housing 200*b*, while the external heat exchanger unit 120 is provided inside the first housing 200*a*.

Figure 11B:
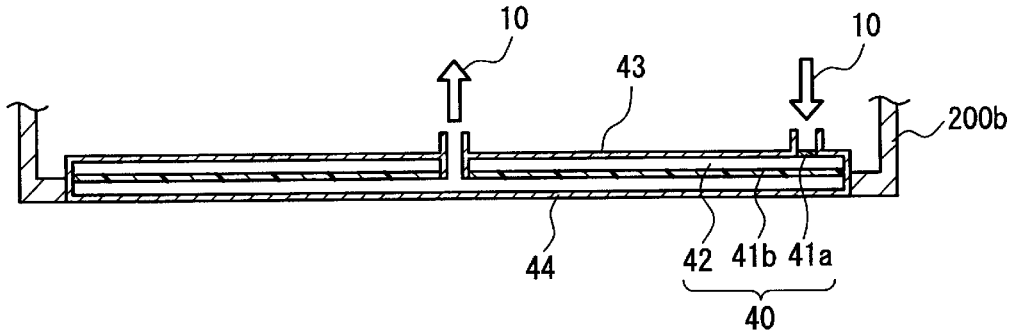
FIG. 11B is a sectional view of a bubble trap portion taken along the line XIB—XIB in FIG. 11A seen from an arrow direction.

FIG. 11B shows a sectional view of the bubble trap portion 40 taken along the line XIB—XIB in FIG. 11A seen from an arrow direction. In FIG. 11B, members having a function similar to that of the bubble trap portion 40 in FIG. 8 are given the same numerals. Although not shown in this figure, the miniature pump portion 101, the internal heat exchanger unit 110 and the heat-generating portion 130 shown in FIG. 11A are arranged above the bubble trap portion 40.

In the present embodiment, the bubble trap portion 40 is exposed to a lower surface of the second housing 200*b* so as to be used also as the external heat exchanger unit 120. In this case, the bubble trap portion 40 is provided so that a passage wall 44 contacting the liquid that has passed through the second filter 41*b* is in contact with the outside and the bubble reservoir 42 is arranged on the side of the heat-generating portion 130. Since substantially no air bubble is present in the liquid that has passed through the second filter 41*b*, it is possible to dissipate heat stably via the passage wall 44. In addition, air bubbles trapped in the bubble reservoir 42 function as a heat insulator, thus preventing heat of the liquid in the bubble trap portion 40 from raising the temperature of components in the second housing 200*b* including the heat-generating portion 130 disposed above the bubble trap portion 40.

In FIGS. 11A and 11B, the bubble trap portion 40 is arranged on the lower surface of the second housing 200*b* so that the passage wall 44 downstream of the bubble trap portion 40 constitutes a part of the bottom surface of the second housing 200*b*. However, the arrangement of the bubble trap portion 40 is not limited to the above. For example, it may be arranged inside the second housing 200*b*, above the circuit board, the miniature pump portion 101, the internal heat exchanger unit 110 and the heat-generating portion 130 and below the keyboard, so that heat is dissipated through a space between keys of the keyboard. Alternatively, it may be arranged so as to constitute a part of an outer surface (a surface opposite to the display panel) of the first housing 200*a*. The bubble trap portion 40 may be divided into plural pieces, which are then arranged at least at two positions out of the lower surface of the second housing 200*b*, the inside of the second housing 200*b* and the outer surface of the first housing 200*a*. In any case, it is preferable that the passage wall 44 is arranged so as to serve as a heat-dissipating surface.

Although the passage wall 44 downstream of the bubble trap portion 40 is exposed to the housing surface in the configuration of the present embodiment, the passage wall 44 also may contact an inner surface of a surface plate of the housing so that heat is dissipated via this surface plate.

Furthermore, in the cooling system shown in FIG. 10 and the portable equipment shown in FIGS. 11A and 11B, the bubble trap portion 40 of the fifth embodiment including two filters as shown in FIG. 8 is used as the bubble trap portion 40. However, the bubble trap portion 40 may include only one filter as in fourth embodiment shown in FIG. 7. Moreover, as long as air bubbles can be trapped in the bubble reservoir, the bubble trap portion does not have to include any filter.

Although a piezoelectric vibrating plate having a piezoelectric substrate as a driving source of the diaphragm is used in the present embodiment, the present invention is not limited to this. A similar effect can be produced by replacing the diaphragm with, for example, a piston as long as it can change the volume of the pressure chamber 50.

In addition, although the above description is directed to an example of using a reciprocating pump, which is a positive-displacement pump, as a liquid delivery mechanism of the miniature pump portion 101, not only the reciprocating pump but also a turbopump such as a rotary pump, a centrifugal pump or an axial-flow pump can be used. By providing the bubble trap portion 40, the similar effect can be produced.

Sixth Embodiment

The following is a description of a sixth embodiment of the present invention, with reference to the accompanying drawings.

Figure 12:
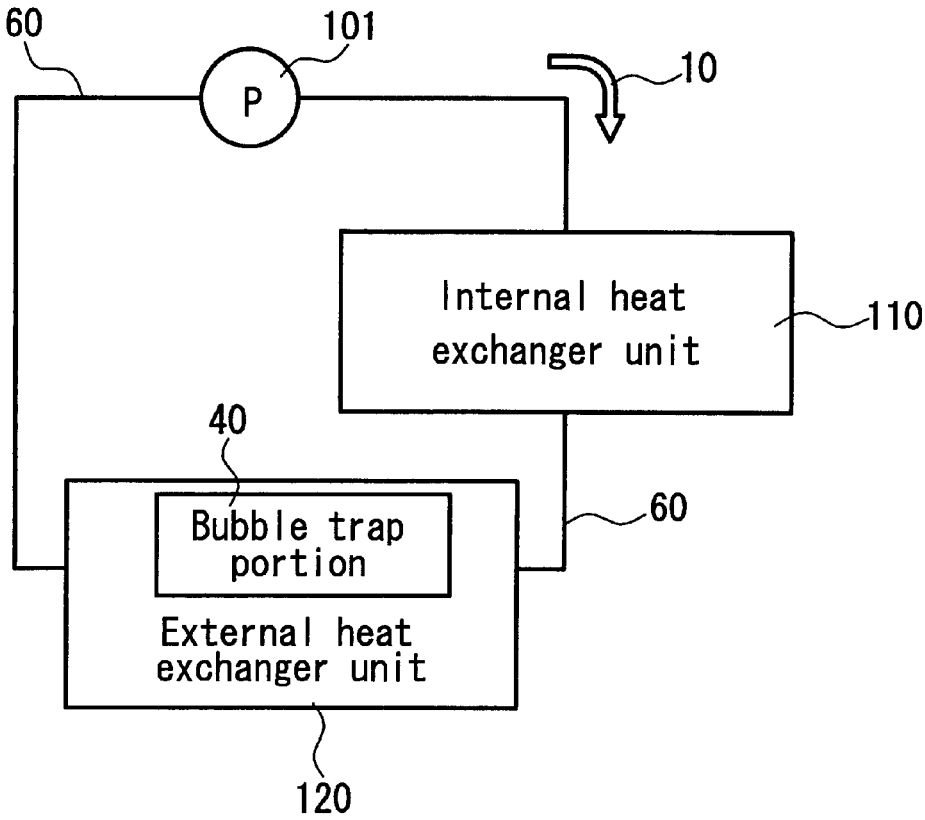
FIG. 12 is a schematic diagram of a cooling system according to a sixth embodiment of the present invention.

FIG. 12 shows a schematic diagram of a cooling system according to the sixth embodiment of the present invention. In this figure, members having a function similar to that of FIG. 10, which shows the cooling system of the fifth embodiment, are given the same numerals.

The present embodiment is different from the fifth embodiment in the following manner. The bubble trap portion 40 is provided as a part of the external heat exchanger unit 120. Also, instead of the diaphragm type positive-displacement pump, a rotary pump (also called a centrifugal pump), which is one type of turbopumps, is used as the miniature pump portion 101.

Figure 13:
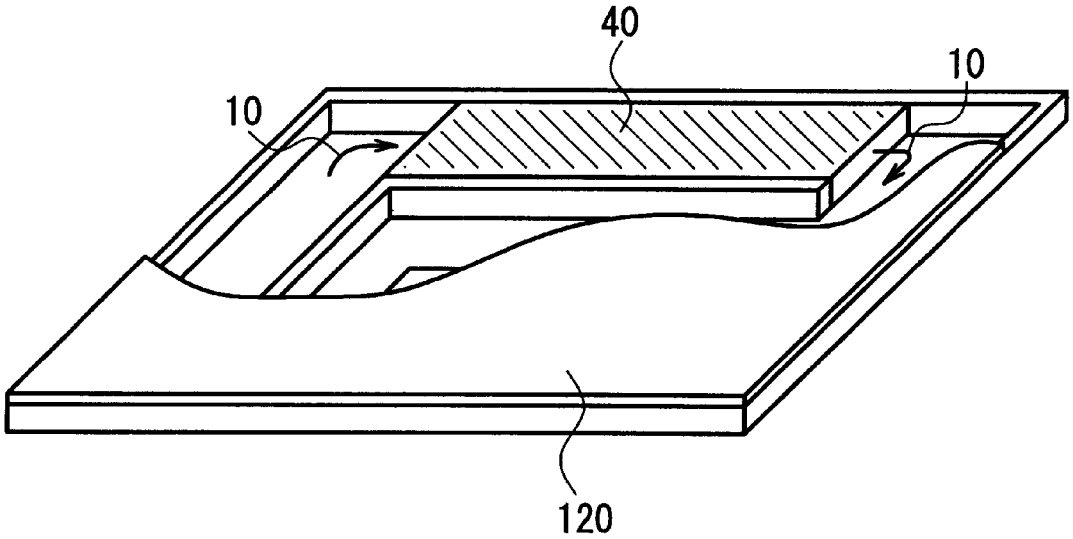
FIG. 13 is a partially broken perspective view showing a schematic arrangement of a bubble trap portion in an external heat exchanger unit of the cooling system shown in FIG. 12.

FIG. 13 illustrates an example of how to arrange the bubble trap portion 40 in the external heat exchanger unit 120. In this figure, the heat-dissipating surface (the upper surface in FIG. 13) of the bubble trap portion 40 is the passage wall 44 downstream of the second filter 41*b* of the bubble trap portion 40 in the fifth embodiment.

Figure 14:
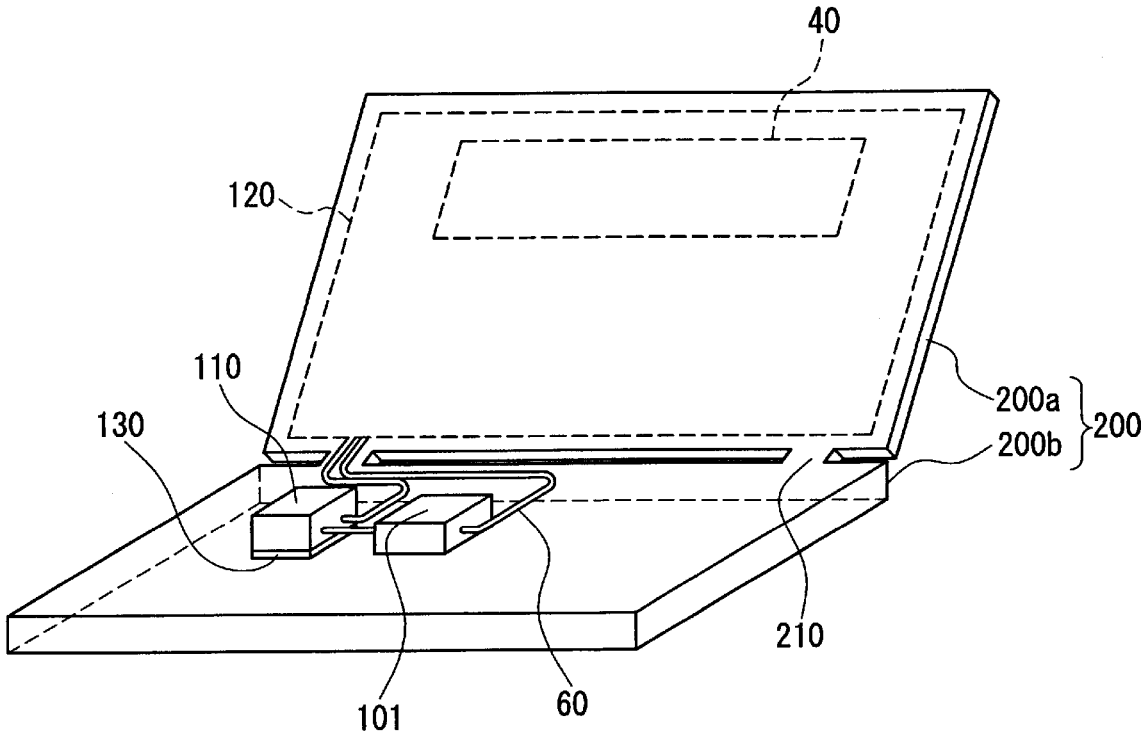
FIG. 14 is a perspective view showing a schematic configuration of portable equipment according to the sixth embodiment of the present invention.

FIG. 14 shows a structural example in the case where the cooling system of the present embodiment is applied to a notebook personal computer, which is an example of portable equipment. In this figure, members having a function similar to that of FIG. 11A are given the same numerals. The portable equipment shown in FIG. 14 is different from that of FIG. 11A in that the bubble trap portion 40 is provided inside the external heat exchanger unit 120 in the first housing 200*a*.

Figure 15:
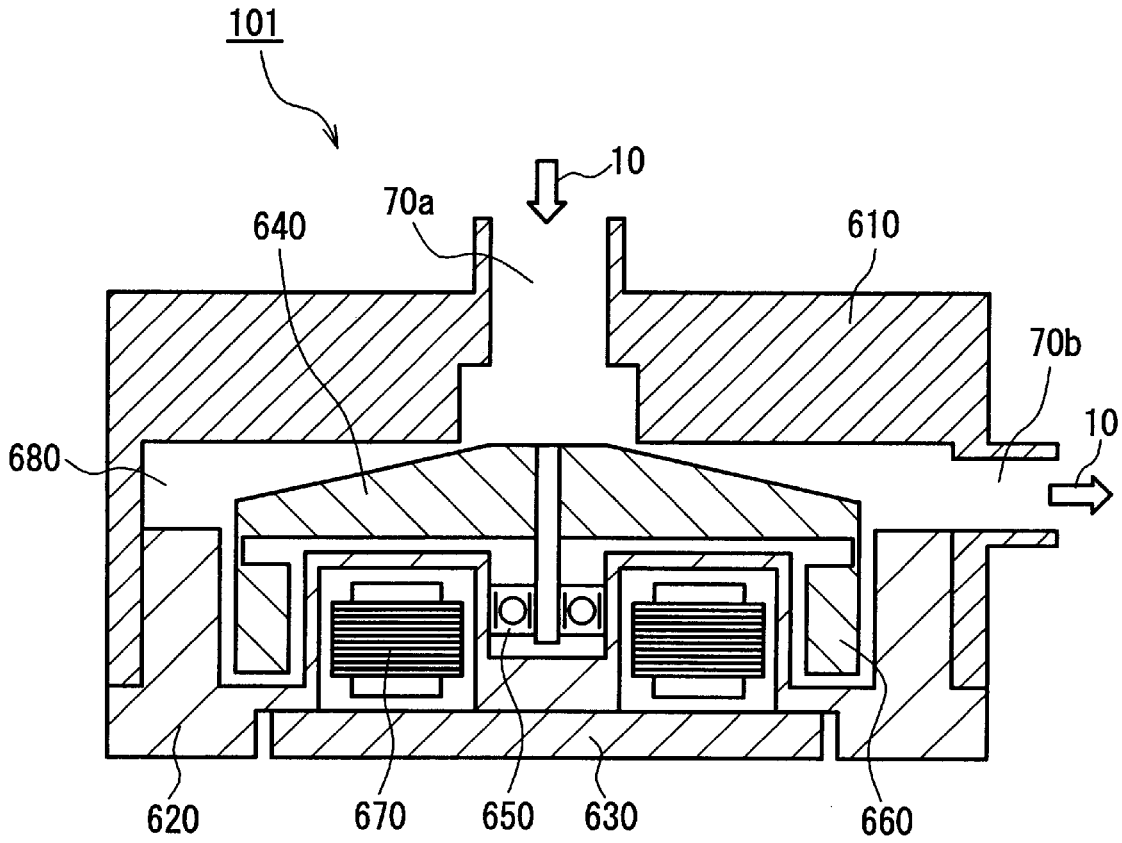
FIG. 15 is a sectional view showing a schematic configuration of a rotary pump used for the portable equipment according to the sixth embodiment of the present invention.

FIG. 15 shows a schematic configuration of a rotary pump constituting the miniature pump portion 101 of the present embodiment. In this figure, numeral 610 denotes a first casing, numeral 620 denotes a second casing, numeral 630 denotes a third casing, numeral 640 denotes an impeller, numeral 650 denotes a bearing, numeral 660 denotes a rotor, and numeral 670 denotes a stator. The impeller 640 is held rotatably by the bearing 650 in a space 680 formed by the first casing 610 and the second casing 620. A suction passage 70*a* is provided along the axis of rotation of the impeller 640, while a discharge passage 70*b* is provided in a radial direction of the impeller 640. Both of the suction passage 70*a* and the discharge passage 70*b* are connected to the space 680. The rotor 660 formed of a permanent magnet is provided on a periphery of the impeller 640. The stator 670 formed of a coil is held in a space formed by the second casing 620 and the third casing 630 so as to face the rotor 660. The miniature pump portion 101 in FIG. 15 is a general rotary-type centrifugal pump that forms a fluid flow utilizing a centrifugal force. By passing an electric current through the coil of the stator 670, an electromagnetic force is generated in the rotor 660, so that a rotary driving force is generated therein. This rotates the impeller 640 to which the rotor 660 is attached. The fluid flowing from the suction passage 70*a* into the space 680 is rotated by the rotation of the impeller 640. This generates a centrifugal force to discharge the fluid vigorously from the discharge passage 70*b*. In this manner, the miniature pump of the present embodiment allows the fluid to flow in directions indicated by arrows 10.

In accordance with the present embodiment described above, an effect similar to the fifth embodiment can be obtained.

Also, by providing the bubble trap portion 40 as a part of the external heat exchanger unit 120, the area that the system as a whole occupies can look smaller.

When providing the bubble trap portion 40 inside the external heat exchanger unit 120, it is preferable that the bubble trap portion 40 is provided so that the passage wall downstream of the bubble trap portion 40 (the passage wall 44 opposing the second filter 41*b* in FIG. 8) corresponds to a heat-dissipating surface of the external heat exchanger unit 120 (the upper surface in FIG. 13). Since substantially no air bubble is present in the liquid that has passed through the bubble trap portion 40, it is possible to maximize the area over which the liquid contacts the passage wall 44. Thus, heat exchanging characteristics via the passage wall 44 improve, making it possible to use the bubble trap portion 40 as a part of the external heat exchanger unit 120 effectively.

Figure 16:
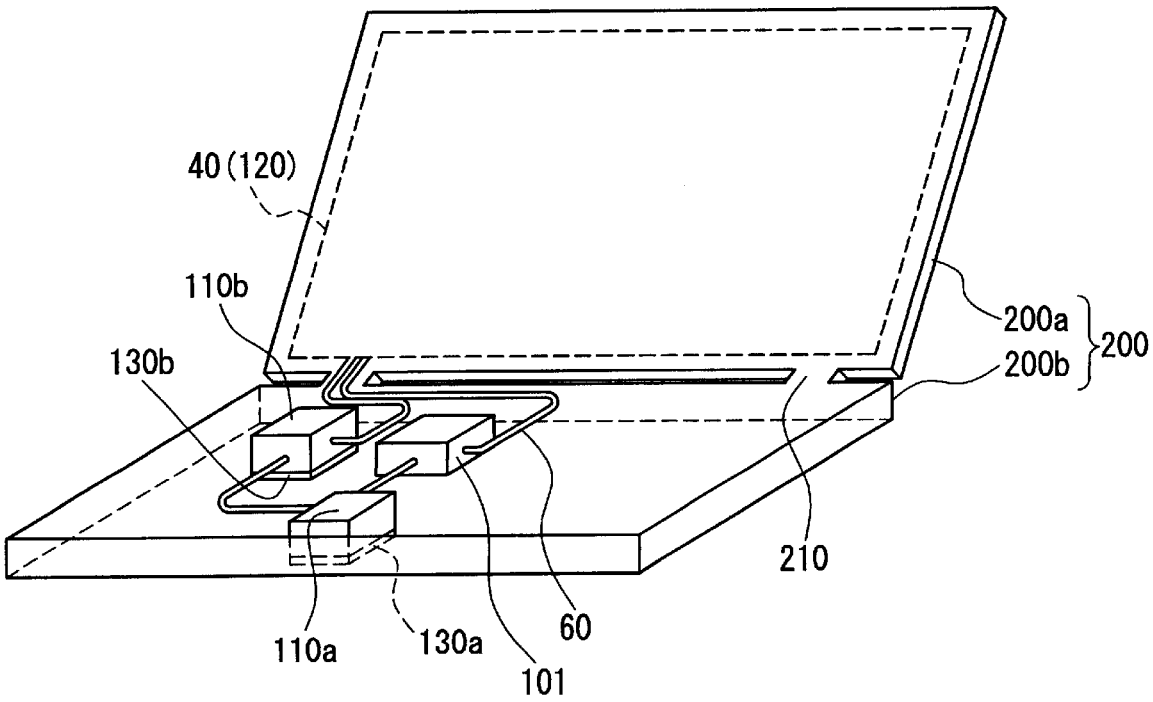
FIG. 16 is a perspective view showing a schematic configuration of another portable equipment according to the sixth embodiment of the present invention.

Although the bubble trap portion 40 is provided so as to constitute a part of the external heat exchanger unit 120 in the present embodiment, the external heat exchanger unit 120 may be constituted entirely by the bubble trap portion, which produces the effect similar to the above. FIG. 16 shows a structural example thereof.

FIG. 16 shows an example of an application to a notebook personal computer as in FIG. 14. In FIG. 16, members having a function similar to that of FIG. 14 are given the same numerals. The portable equipment shown in FIG. 16 is different from that shown of FIG. 14 in the following manner. The bubble trap portion 40 is used as the external heat exchanger unit 120, and no member serving as the external heat exchanger unit is provided other than the bubble trap portion 40. In addition, a plurality of internal heat exchanger units (two in the present example, namely, a first internal heat exchanger unit 110*a* and a second internal heat exchanger unit 110*b*) are provided in correspondence with a plurality of heat-generating portions (two in the present example, namely, a first heat-generating portion (for example, a CPU) 130*a* and a second heat-generating portion (for example, a video chip) 130*b*).

The passage wall 44 is exposed to the outer surface (the surface opposite to the display panel) of the first housing 200*a* so that the passage wall 44 downstream of the bubble trap portion 40 serves as a heat-dissipating surface. This can expand an inner volume of the bubble reservoir 42 of the bubble trap portion 40 and a filter area, and therefore, performance does not deteriorate even when still more air bubbles are trapped. Since substantially no air bubble is present in the liquid that contacts the heat-dissipating surface, it is possible to achieve excellent heat exchanging characteristics similar to those in the case where the bubble trap portion 40 is provided separately from and upstream of the external heat exchanger unit. Moreover, since the external heat exchanger unit is not provided as an independent member, portable equipment can be miniaturized.

The bubble trap portion 40 does not have to be arranged inside the first housing 200*a* as shown in FIG. 16 but may be arranged on the lower surface of the second housing 200*b* or inside the second housing 200*b*. Also, the bubble trap portion 40 may be divided into plural pieces, which then may be arranged at plural positions. Furthermore, the passage wall 44 serving as the heat-dissipating surface does not have to constitute a part of the outer surface of the housing as shown in FIG. 16, but may be in contact with the inner surface of the surface plate of the housing.

In FIG. 16, the portable equipment includes the necessary number of the internal heat exchanger units depending on the number of heat-generating portions. This makes it possible to absorb heat generated in a plurality of the heat-generating portions efficiently, convey it to the external heat exchanger unit 120 and then dissipate it. Furthermore, even when there are a plurality of the heat-generating portions, the internal heat exchanger units can be provided depending on the installing positions of the heat-generating portions, thereby enhancing a degree of flexibility in designing the arrangement of the plurality of heat-generating portions. Conventionally, a plurality of heat-generating components have needed to be arranged altogether on one internal heat exchanger unit, and a component having a low heat resistance has been required to be arranged away from a heat-generating component. Such restriction on the component arrangement is relaxed, making it easier to design equipment.

Moreover, although a rotary pump is used as the miniature pump portion 101 in the present embodiment, there is no particular limitation. As long as the system is configured such that the miniature pump portion 101 and the bubble trap portion are in communication with each other, a similar effect can be obtained even with a pump driven in a different manner.

In addition, although the above description is directed to an example of using the configuration similar to that of the fifth embodiment as the bubble trap portion 40, configurations shown in the other embodiments may be applied.

Seventh Embodiment

The following is a description of a seventh embodiment of the present invention, with reference to the accompanying drawings.

Figure 17:
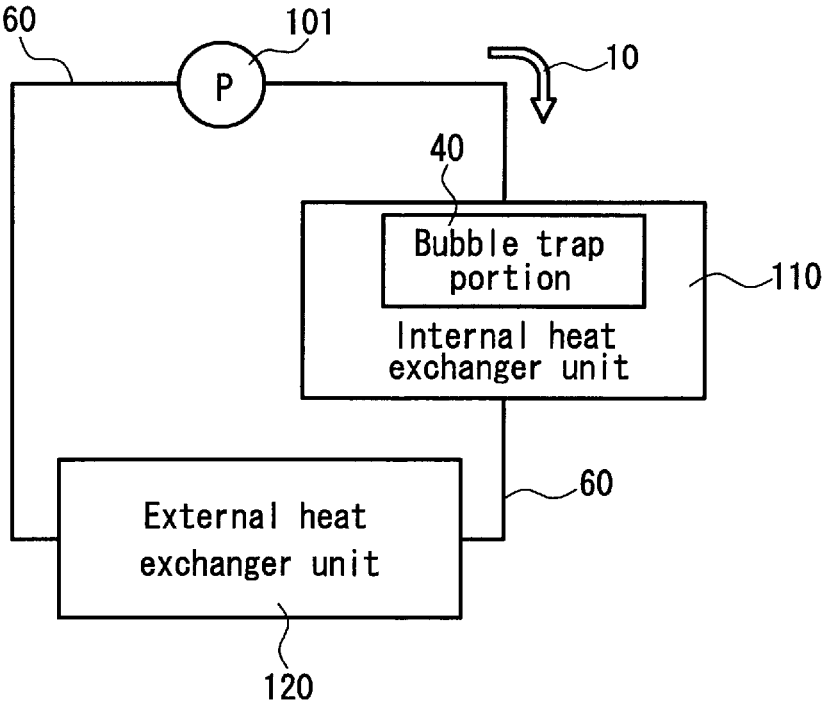
FIG. 17 is a schematic diagram of a cooling system according to a seventh embodiment of the present invention.
Figure 18:
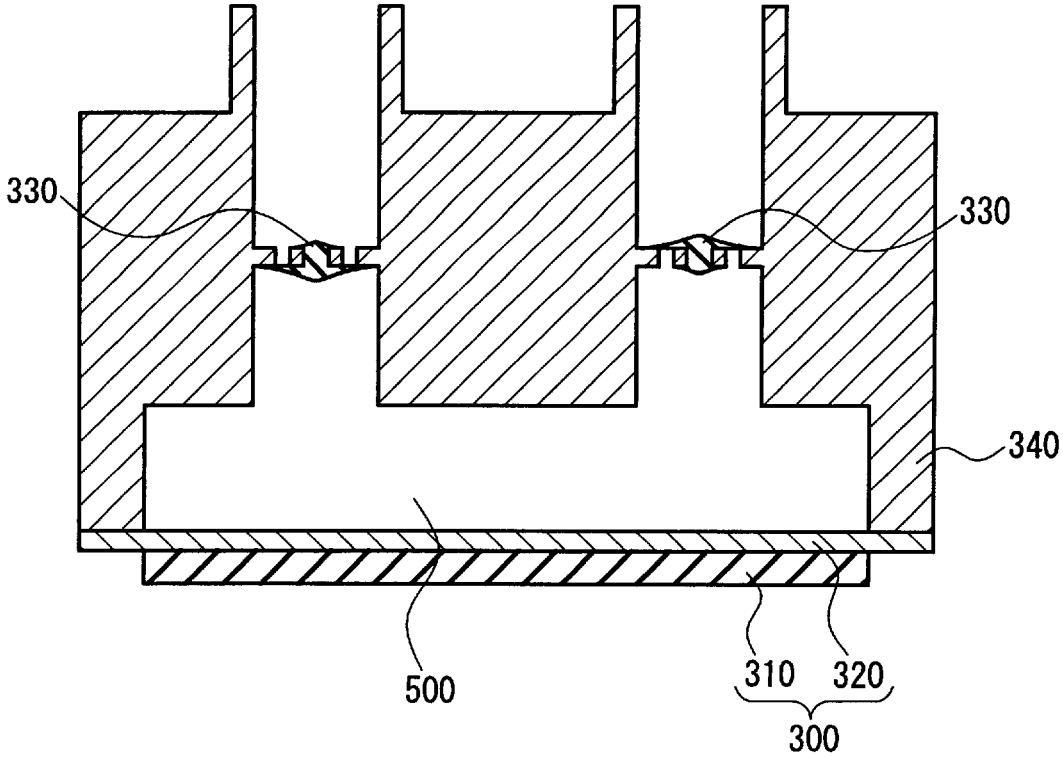
FIG. 18 PRIOR ART
FIG. 18 is a schematic sectional view showing a conventional miniature pump.
Figure 19A:
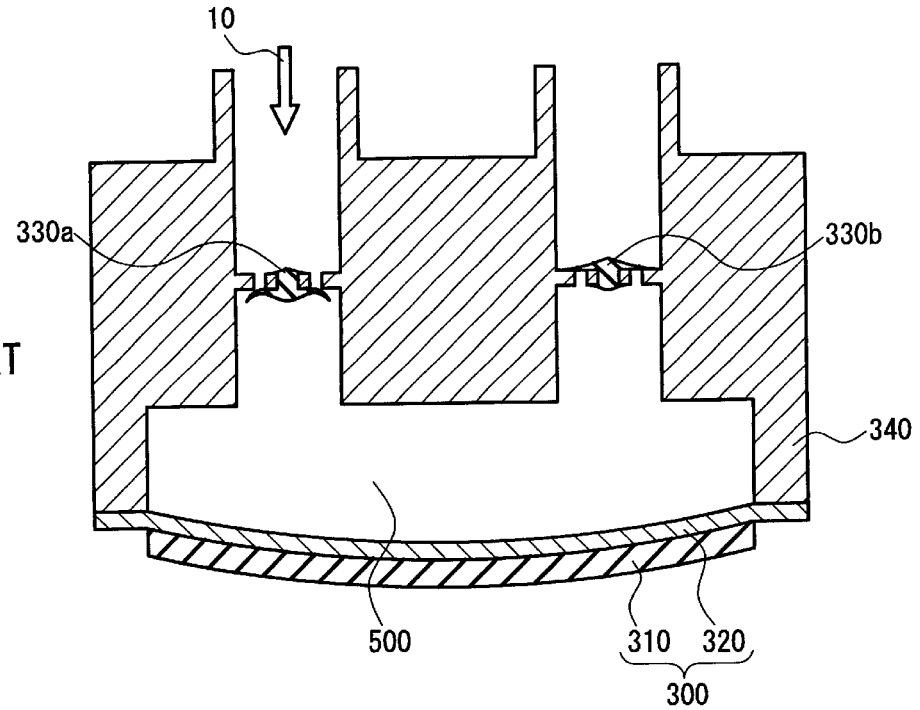
FIG. 19A PRIOR ART
FIG. 19A is a schematic sectional view showing a sucking operation of the conventional miniature pump.
Figure 19B:
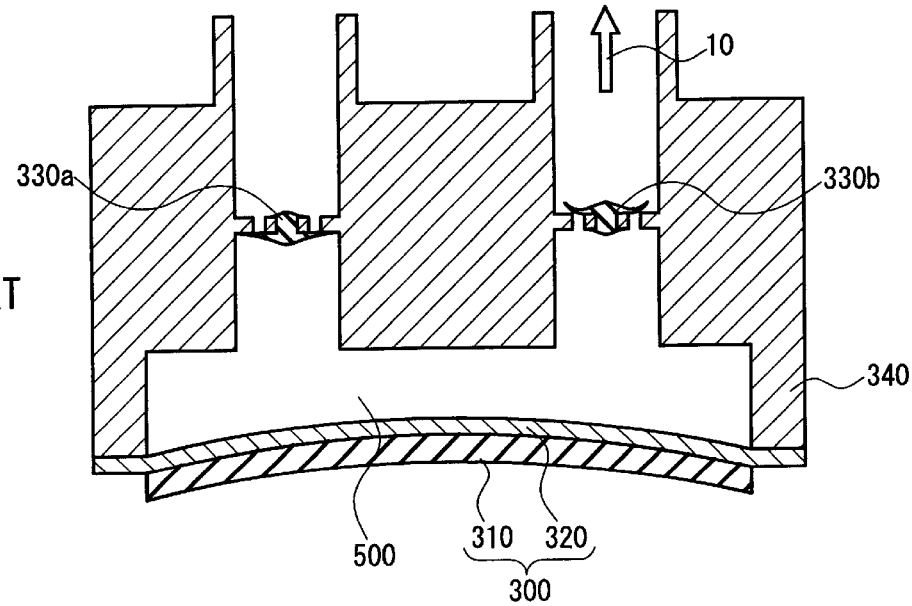
FIG. 19B PRIOR ART
FIG. 19B is a schematic sectional view showing a discharging operation of the conventional miniature pump.

FIG. 17 shows a schematic diagram of a cooling system according to the seventh embodiment of the present invention. In this figure, members having a function similar to that of FIG. 10, which shows the cooling system of the fifth embodiment, are given the same numerals.

The present embodiment is different from the fifth embodiment in that the bubble trap portion 40 is provided as a part of the internal heat exchanger unit 110. There is no particular limitation on how to arrange the bubble trap portion 40 in the internal heat exchanger unit 110. For example, it can be arranged similarly to the case of FIG. 13, which shows an arrangement example in the external heat exchanger unit 120.

In accordance with the present embodiment described above, an effect similar to the fifth embodiment can be obtained.

Also, by providing the bubble trap portion 40 as a part of the internal heat exchanger unit 110, the area that the system as a whole occupies can look smaller.

When providing the bubble trap portion 40 inside the internal heat exchanger unit 110, it is preferable that the bubble trap portion 40 is provided so that the passage wall downstream of the bubble trap portion 40 (the passage wall 44 opposing the second filter 41*b* in FIG. 8) corresponds to a heat-absorbing surface of the internal heat exchanger unit 110 (the surface on the side of a heat-generating component). This improves heat exchanging characteristics.

Although the bubble trap portion 40 is provided so as to constitute a part of the internal heat exchanger unit 110 in the present embodiment, the internal heat exchanger unit 110 entirely may be constituted by the bubble trap portion, which produces the effect similar to the above. In this case, it is preferable that the entire heat-absorbing surface of the internal heat exchanger unit 110 corresponds to the passage wall 44 downstream of the bubble trap portion 40. This can expand an inner volume of the bubble reservoir 42 of the bubble trap portion 40 and a filter area, and therefore, performance does not deteriorate even when still more air bubbles are trapped. Since substantially no air bubble is present in the liquid that contacts the heat-absorbing surface, it is possible to achieve excellent heat exchanging characteristics similar to those in the case where the bubble trap portion 40 is provided separately from and upstream of the internal heat exchanger unit. Moreover, since the internal heat exchanger unit need not be provided as an independent member, portable equipment can be miniaturized.

Although the bubble trap portion 40 is provided inside the internal heat exchanger unit 110 in the present embodiment, it can be arranged not only inside the internal heat exchanger unit 110 but inside the external heat exchanger unit 120 at the same time, thereby making it possible to increase a volume of the bubble trap portion 40 without changing a volume of the entire system. As a result, an inner volume of the bubble reservoir 42 and a filter area are expanded, and therefore, still more air bubbles can be trapped without deteriorating the performance.

Further, although the above description is directed to an example of using a reciprocating pump, which is a positive-displacement pump, as a liquid delivery mechanism of the miniature pump portion 101, not only the reciprocating pump but also a turbopump such as a rotary pump, a centrifugal pump or an axial-flow pump can be used to produce the similar effect.

In addition, although the above description is directed to an example of using the configuration similar to that of the fifth embodiment as the bubble trap portion 40, configurations shown in the other embodiments may be applied.

Although a notebook personal computer is illustrated as the portable equipment in the above description, the present invention is not limited to the above but may be applied to easy-to-carry miniature electronic equipment such as a PDA (personal digital assistance) or a cellular phone.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A miniature pump comprising:

a miniature pump portion comprising a suction passage through which a liquid flows in, and a discharge passage through which the liquid flows out; and a bubble trap portion for blocking an entry of air bubbles into the miniature pump portion;

wherein the bubble trap portion comprises one or more filters and a bubble reservoir, at least one of the filters serves as an inner surface of the bubble reservoir, and $X \leqq (2\sigma/\rho g)^{1/2}$ is satisfied where X is a distance between the one of the filters serving as the inner surface and an inner surface of the bubble reservoir opposed thereto, $\sigma$ is a surface tension of a liquid to be used, $\rho$ is a density thereof and g is a gravitational acceleration.

2. A cooling system comprising:

the miniature pump according to claim 1, an internal heat exchanger unit;

an external heat exchanger unit; and a pipe for connecting the miniature pump, the internal heat exchanger unit and the external heat exchanger unit.

3. A portable equipment, comprising the cooling system according to claim 2.

4. A cooling system comprising:

a miniature pump comprising a miniature pump portion comprising a suction passage through which a liquid flows in, and a discharge passage through which the liquid flows out; and a bubble trap portion for blocking entry of air bubbles into the miniature pump portion;

an internal heat exchanger unit;

an external heat exchanger unit; and a pipe for connecting the miniature pump, the internal heat exchanger unit and the external heat exchanger unit;

wherein the bubble trap portion is arranged as at least a part of one or both of the internal heat exchanger unit and the external heat exchanger unit.

5. A portable equipment, comprising the cooling system according to claim 4.

6. A cooling system comprising according:

a miniature pump comprising a miniature pump portion comprising a suction passage through which a liquid flows in, and a discharge passage through which the liquid flows out; and a bubble trap portion for blocking an entry of air bubbles into the miniature pump portion;

an internal heat exchanger unit;

an external heat exchanger unit; and a pipe for connecting the miniature pump, the internal heat exchanger unit and the external heat exchanger unit;

wherein the bubble trap portion is at least one of the internal heat exchanger unit and the external heat exchanger unit.

7. A portable equipment, comprising the cooling system according to claim 6.

8. A cooling system comprising:

a miniature pump comprising a miniature pump portion comprising a suction passage through which a liquid flows in, and a discharge passage through which the liquid flows out; and a bubble trap portion for blocking an entry of air bubbles into the miniature pump portion;

an internal heat exchanger unit;

an external heat exchanger unit; and a pipe for connecting the miniature pump, the internal heat exchanger unit and the external heat exchanger unit;

wherein a passage wall downstream of the bubble trap portion serves as a heat-absorbing surface of the internal heat exchanger unit or a heat-dissipating surface of the external heat exchanger unit.

9. A portable equipment, comprising the cooling system according to claim 8.

10. A portable equipment, comprising:

a cooling system comprising a miniature pump comprising a miniature pump portion comprising a suction passage through which a liquid flows in, and a discharge passage through which the liquid flows out; and a bubble trap portion for blocking an entry of air bubbles into the miniature pump portion;

an internal heat exchanger unit;

an external heat exchanger unit; and a pipe for connecting the miniature pump, the internal heat exchanger unit and the external heat exchanger unit; and a heat-generating portion;

wherein a passage wall downstream of the bubble trap portion contacts the heat-generating portion.

11. A portable equipment, comprising:

a cooling system comprising;

a miniature pump comprising;

a miniature pump portion comprising a suction passage through which a liquid flows in, and a discharge passage through which the liquid flows out; and a bubble trap portion for blocking an entry of air bubbles into the miniature pump portion;

an internal heat exchanger unit;

an external heat exchanger unit; and a pipe for connecting the miniature pump, the internal heat exchanger unit and the external heat exchanger unit;

wherein a passage wall downstream of the bubble trap portion contacts a surface plate of a housing or serves as a part of a surface of the housing.

* * * * *